US010409199B2

(12) United States Patent
Eto et al.

(10) Patent No.: US 10,409,199 B2
(45) Date of Patent: Sep. 10, 2019

(54) IMAGE FORMING APPARATUS WITH SENSOR TO DETECT DEVELOPER IN STORAGE CONTAINER AND TO DETECT POSITION OF COVER FOR COVERING INTERNAL SPACE WHERE STORAGE CONTAINER IS DISPOSED

(71) Applicant: KYOCERA Document Solutions Inc., Osaka-shi (JP)

(72) Inventors: Daisuke Eto, Osaka (JP); Riku Minamoto, Osaka (JP); Koichi Hayashi, Osaka (JP); Takahisa Nakaue, Osaka (JP); Sadanori Nakae, Osaka (JP); Daichi Kawano, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/127,515

(22) Filed: Sep. 11, 2018

(65) Prior Publication Data

US 2019/0086838 A1 Mar. 21, 2019

(30) Foreign Application Priority Data

Sep. 15, 2017 (JP) ..... 2017-177610

(51) Int. Cl.

| | |
|---|---|
| ***G03G 15/00*** | (2006.01) |
| ***G03G 15/08*** | (2006.01) |
| ***G03G 15/095*** | (2006.01) |
| *G03G 15/09* | (2006.01) |

(52) U.S. Cl.

CPC ..... *G03G 15/095* (2013.01); *G03G 15/0856* (2013.01); *G03G 15/0868* (2013.01); *G03G 15/556* (2013.01); *G03G 15/09* (2013.01)

(58) Field of Classification Search

CPC ..... G03G 15/0856; G03G 15/0863; G03G 15/0865; G03G 15/0868; G03G 15/556; G03G 21/1623; G03G 21/1633

USPC ..... 399/9, 27, 110, 119, 258, 262

See application file for complete search history.

(56) References Cited

U.S. PATENT DOCUMENTS 9,513,579 B2 * 12/2016 Makie et al. ..... G03G 15/0856

FOREIGN PATENT DOCUMENTS

JP 2015-127789 7/2015

* cited by examiner

*Primary Examiner* — William J Royer

(74) *Attorney, Agent, or Firm* — Gerald E. Hespos; Michael J. Porco; Matthew T. Hespos

(57) ABSTRACT

An image forming apparatus includes a housing in which a developing device is disposed, a cover member attached to the housing, a developer storage container to be detachably attached to the developing device, and a sensor unit. The developer storage container includes a container body having a storage space for storing a developer and a developer discharge port, and a moving wall configured to move in the container body. The sensor unit is arranged at a detection position where a detection sensor faces a specific area located above the developer discharge port on an outer peripheral surface of the container body when the cover member is in a closing posture, and arranged at a detection disable position where the detection sensor is distant from the specific area when the cover member is in an opening posture.

4 Claims, 27 Drawing Sheets

IMAGE FORMING APPARATUS WITH SENSOR TO DETECT DEVELOPER IN STORAGE CONTAINER AND TO DETECT POSITION OF COVER FOR COVERING INTERNAL SPACE WHERE STORAGE CONTAINER IS DISPOSED

INCORPORATION BY REFERENCE

This application is based on Japanese Patent Application No. 2017-177610 filed with the Japan Patent Office on Sep. 15, 2017, the contents of which are hereby incorporated by reference.

BACKGROUND

The present disclosure relates to an image forming apparatus provided with a developer storage container for storing a developer.

Conventionally, an image forming apparatus with an image carrier configured to carry a developer image to be transferred to a sheet, a developing device configured to supply a developer to the image carrier and a developer storage container detachably attached to the developing device and configured to store the developer to be replenished into the developing device is known as an image forming apparatus for forming an image on a sheet.

A developer storage container with a moving wall for conveying a developer toward a developer discharge port by moving along a shaft in an internal space where the developer is stored is known as a prior art. In this art, a decrease of the developer stored in the internal space according to replenishment into the developing device is detected by a detection sensor and the moving wall is moved in accordance with an output signal of the detection sensor.

SUMMARY

An image forming apparatus according to one aspect of the present disclosure includes a housing, a cover member, a developer storage container, a sensor unit and a moving wall drive controller. The housing includes an opening communicating with an internal space where a developing device is disposed. The cover member is attached to the housing and capable of changing a posture between an opening posture for opening the opening and a closing posture for closing the opening. The developer storage container is detachably attached to the developing device and includes a container body and a moving wall. The container body has a storage space extending in a first direction and capable of storing a developer and is formed with a developer discharge port through which the developer is discharged to the developing device. The moving wall conveys the developer in the storage space toward the developer discharge port by moving in the first direction in the storage space. The sensor unit includes a detection sensor configured to detect the developer stored in the storage space of the container body and output a signal corresponding to the detection. The moving wall drive controller controls a movement of the moving wall based on an output signal output from the detection sensor. The sensor unit is mounted on the cover member and displaced between a detection position where the developer is detectable by the detection sensor and a detection disable position where the developer is not detectable by the detection sensor as the posture of the cover member is changed. The sensor unit is arranged at the detection position where the detection sensor faces a specific area located above the developer discharge port on an outer peripheral surface of the container body when the cover member is in the closing posture, and arranged at the detection disable position where the detection sensor is distant from the specific area when the cover member is in the opening posture.

DETAILED DESCRIPTION

Figure 1:
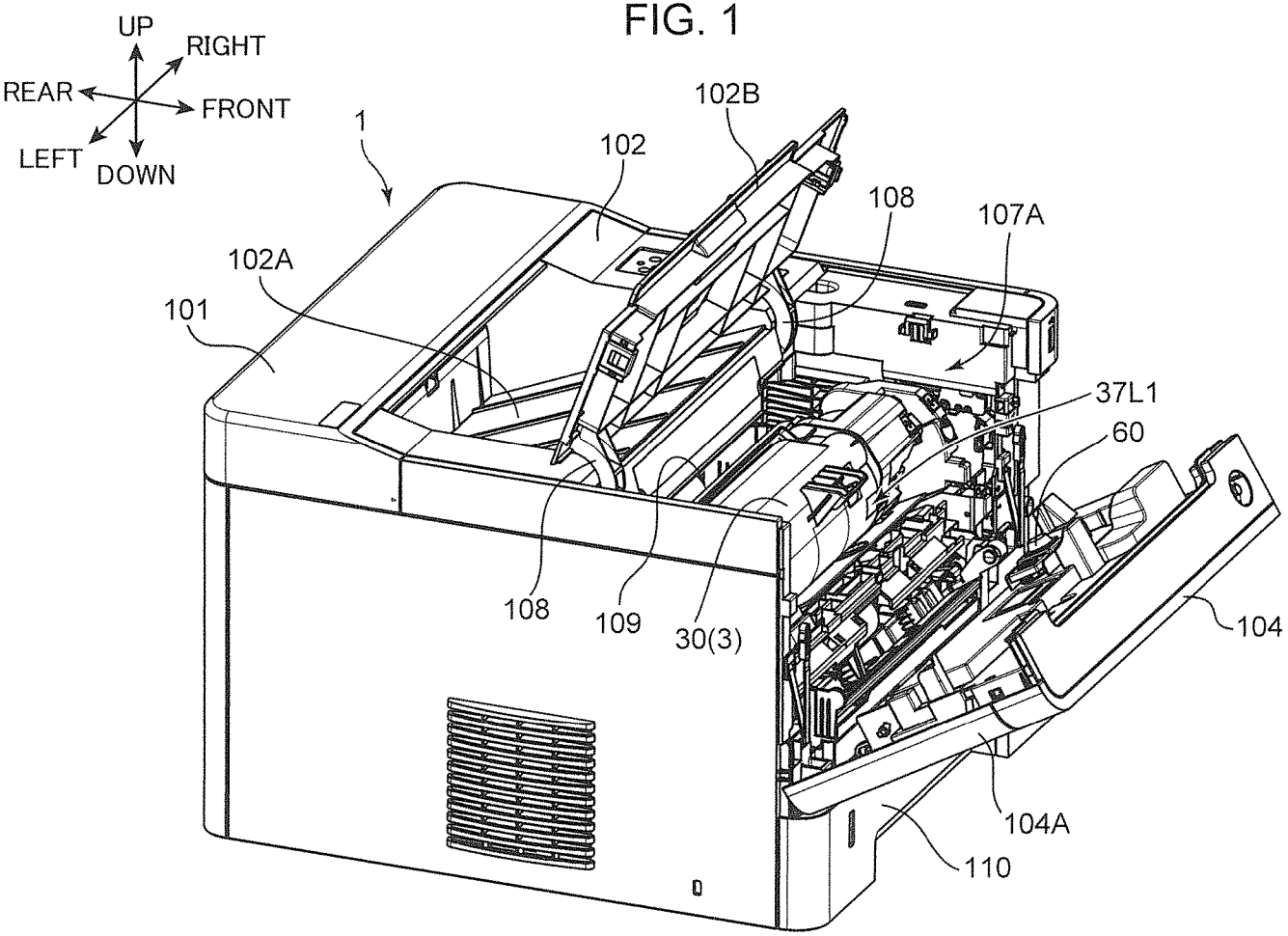
FIG. 1 is a perspective view showing an image forming apparatus according to one embodiment of the present disclosure.
Figure 2:
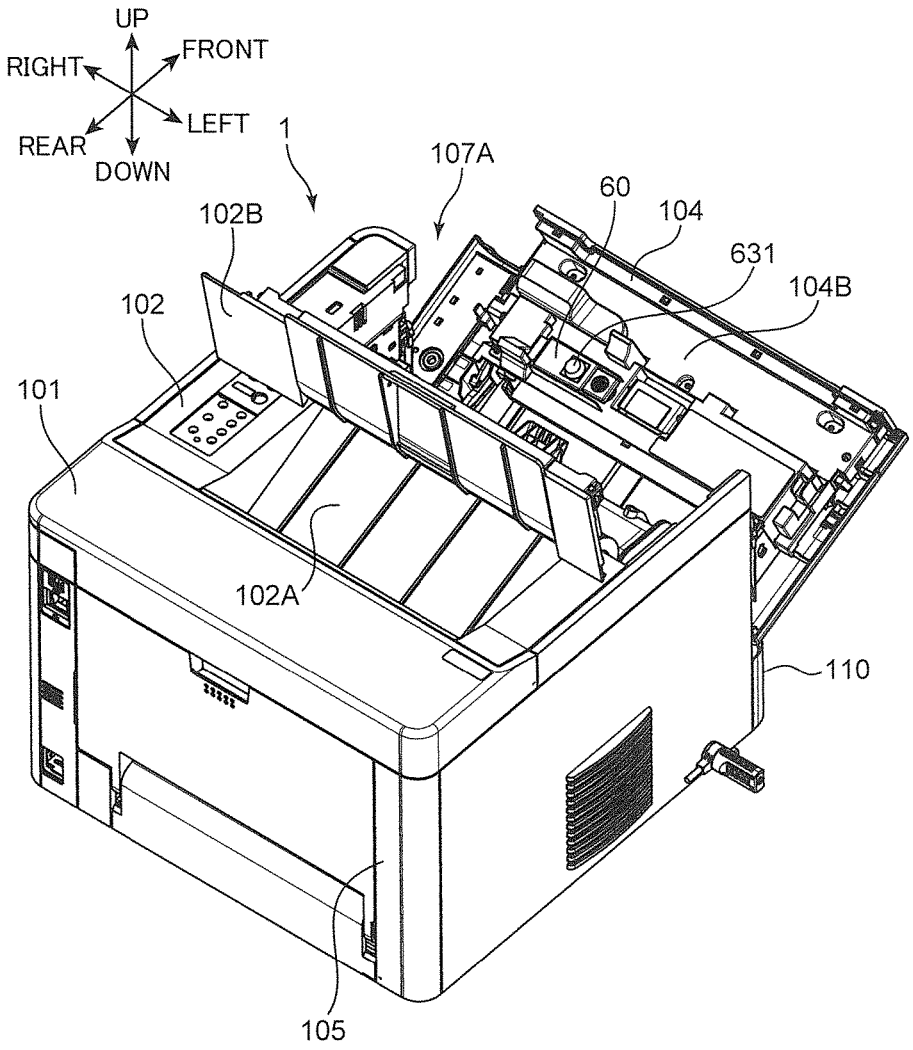
FIG. 2 is a perspective view of the image forming apparatus viewed from a viewpoint different from that of FIG. 1.
Figure 3:
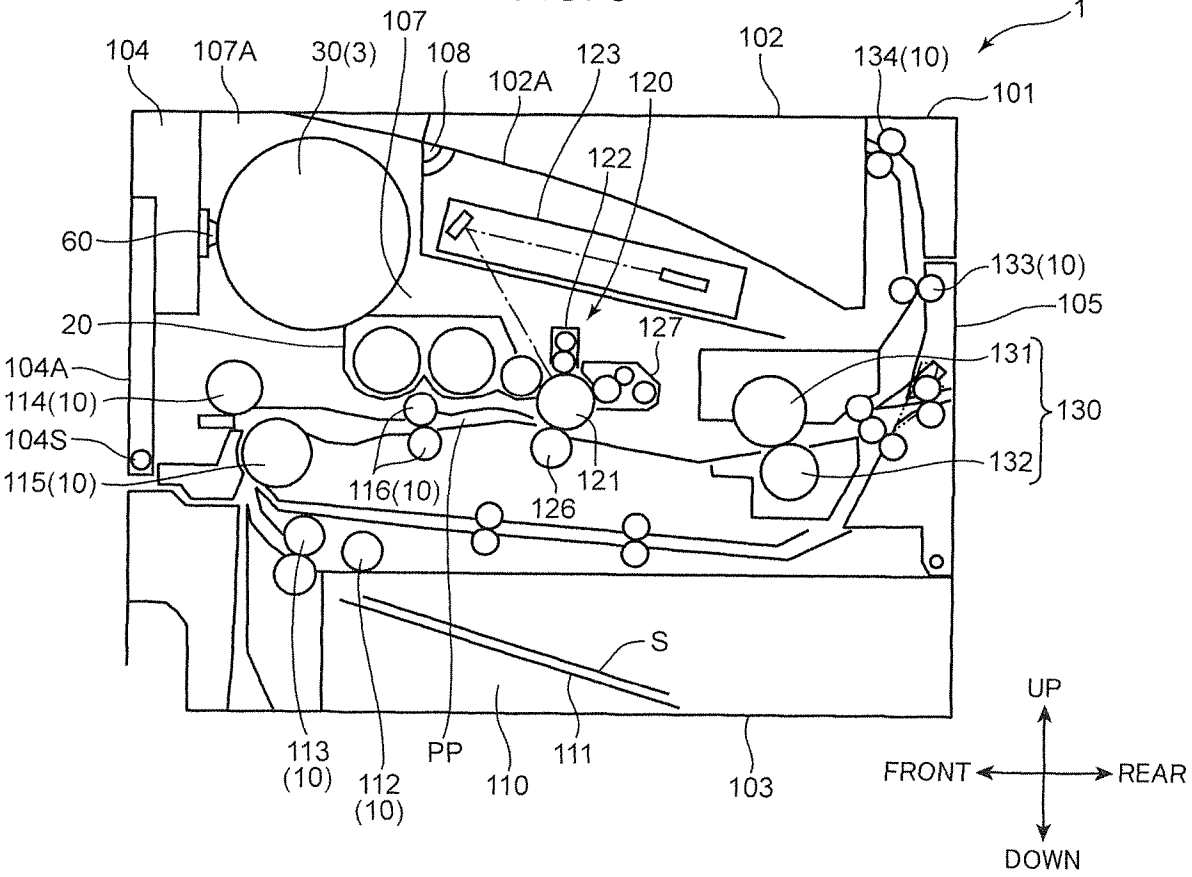
FIG. 3 is a sectional view schematically showing an internal structure of the image forming apparatus.

Hereinafter, one embodiment of the present disclosure is described with reference to the drawings. FIGS. 1 and 2 are perspective views of an image forming apparatus 1 according to the embodiment of the present disclosure. FIG. 3 is a sectional view schematically showing an internal structure of the image forming apparatus 1 shown in FIGS. 1 and 2. Note that the image forming apparatus 1 in a state where a housing 101 is partially opened is shown in FIGS. 1 and 2.

The image forming apparatus 1 shown in FIGS. 1 to 3 is a so-called monochrome printer. However, in another embodiment, the image forming apparatus 1 may be a color printer, a facsimile machine, a complex machine provided with these functions or another apparatus for forming a toner image on a sheet. Note that direction-indicating terms such as "up" and "down", "front" and "rear", "left" and "right" used in the following description are merely for the purpose of clarifying the description and do not limit the principle of the image forming apparatus 1 at all.

<Overall Configuration of Image Forming Apparatus>

The image forming apparatus 1 includes the housing 101 for housing various devices for forming an image on a sheet S. As shown in FIG. 3, the housing 101 is formed into a box shape having an internal space 107 in which various devices are disposed, and an opening 107A communicating with the internal space 107 is provided on a front side. The housing 101 includes an upper wall 102 defining the upper surface of the housing 101, a bottom wall 103 (FIG. 3) defining the bottom surface of the housing 101 and a body rear wall 105 (FIGS. 2 and 3) between the upper wall 102 and the bottom wall 103.

A front cover 104 defining the front surface of the housing 101 is attached to the housing 101. The front cover 104 is a cover member attached at a position facing the body rear wall 105 in a front-rear direction in the housing 101 to open and close the opening 107A. The front cover 104 can change a posture between an opening posture for opening the opening 107A and a closing posture for closing the opening 107A by being rotated about a shaft portion 104S (FIG. 3) extending in a lateral direction. In a state where the front cover 104 is in the opening posture, a front side of the internal space 107 is opened to outside. On the other hand, in a state where the front cover 104 is in the closing posture, the front side of the internal space 107 is closed. Note that the front cover 104 is in the opening posture in FIGS. 1 and 2.

Further, an upper cover 102B defining a part of the upper surface of the housing 101 is attached to a front part of the upper wall 102 in the housing 101. The upper cover 102B can change a posture between an opening posture and a closing posture by being rotated about unillustrated hinge shafts arranged on a pair of arm portions 108 arranged on both end parts in a lateral direction. In a state where the upper cover 102B is in the opening posture, an upper side of the internal space 107 is opened to outside. On the other hand, in a state where the upper cover 102B is in the closing posture, the upper side of the internal space 107 is closed. Note that the upper cover 102B is in the opening posture in FIGS. 1 and 2.

A sheet conveyance path PP in which a sheet S is conveyed in a predetermined conveying direction extends in the internal space 107 of the housing 101.

A sheet discharge portion 102A is arranged in a central part of the upper wall 102. The sheet discharge portion 102A is formed of an inclined surface inclined downward from a front part to a rear part of the upper wall 102. A sheet S having an image formed thereon in an image forming unit 120 to be described later is discharged to the sheet discharge portion 102A. Further, a manual feed tray 104A is arranged in the front cover 104. The manual feed tray 104A is vertically rotatable about a lower end.

With reference to FIG. 3, the image forming apparatus 1 includes a sheet conveying unit 10, the image forming unit 120 and a fixing device 130. The sheet conveying unit 10 is a mechanism for conveying the sheet S from a cassette 110 to the sheet discharge portion 102A by way of the image forming unit 120 and the fixing device 130. The sheet conveying unit 10 includes a pickup roller 112 arranged upstream of the image forming unit 120 in a sheet conveying direction, a first feed roller 113, a second feed roller 114, a conveyor roller 115, a pair of registration rollers 116 and a pair of conveyor rollers 133 and a pair of discharge rollers 134 arranged downstream of the fixing device 130 in the sheet conveying direction.

The cassette 110 stores sheets S inside. The cassette 110 includes a lift plate 111. The lift plate 111 is inclined to push up the leading end edges of the sheets S. The cassette 110 can be pulled out forward with respect to the housing 101.

The pickup roller 112 is arranged above the leading end edges of the sheets S pushed up by the lift plate 111. When the pickup roller 112 rotates, the sheet S is pulled out from the cassette 110.

The first feed roller 113 is disposed downstream of the pickup roller 112 and feeds the sheet S to a further downstream side. The second feed roller 114 is disposed inwardly (rearwardly) of a pivot point of the manual feed tray 104A and pulls a sheet S on the manual feed tray 104A into the housing 101.

The conveyor roller 115 is disposed downstream of the first feed roller 113 and the second feed roller 114 in the sheet conveying direction. The conveyor roller 115 conveys the sheet S fed by the first and second feed rollers 113, 114 to a further downstream side.

The pair of registration rollers 116 have a function of correcting the oblique feed of the sheet S. In this way, the position of an image to be formed on the sheet S is adjusted. The pair of registration rollers 116 feed the sheet S to the image forming unit 120 in accordance with an image formation timing by the image forming unit 120.

The sheet S after a fixing process in the fixing device 130 is conveyed upwardly by the pair of conveyor rollers 133 and finally discharged from the housing 101 by the pair of discharge rollers 134. The sheet S discharged from the housing 101 is stacked on the sheet discharge portion 102A.

The image forming unit 120 includes a photoconductive drum 121, a charger 122, an exposure device 123, a developing device 20, a toner replenishing device 3, a transfer roller 126 and a cleaning device 127.

The photoconductive drum 121 has a cylindrical shape. The photoconductive drum 121 rotates about a shaft extending in the lateral direction, has a surface on which an electrostatic latent image is to be formed, and carries a toner image (developer image) corresponding to the electrostatic latent image on the surface. The charger 122 substantially uniformly charges the surface of the photoconductive drum 121 by having a predetermined voltage applied thereto.

The exposure device 123 irradiates laser light to the surface of the photoconductive drum 121 charged by the charger 122. As a result, an electrostatic latent image corresponding to image data is formed on the surface of the photoconductive drum 121.

The developing device 20 supplies toner (developer) to the surface of the photoconductive drum 121 having an electrostatic latent image formed thereon. The toner replenishing device 3 replenishes the toner into the developing device 20. When the developing device 20 supplies the toner to the photoconductive drum 121, an electrostatic latent image formed on the surface of the photoconductive drum 121 is developed (visualized). As a result, a toner image (developer image) is formed on the surface of the photoconductive drum 121.

The transfer roller 126 is arranged below the photoconductive drum 121 to face the photoconductive drum 121 across the sheet conveyance path PP. A transfer nip portion is formed between the transfer roller 126 and the photoconductive drum 121, and the transfer roller 126 transfers the toner image to the sheet S.

The cleaning device 127 removes the toner remaining on the surface of the photoconductive drum 121 after the toner image is transferred to the sheet S.

The fixing device 130 is arranged downstream of the image forming unit 120 in the sheet conveying direction and fixes the toner image on the sheet S. The fixing device 130 includes a heating roller 131 for melting the toner on the sheet S and a pressure roller 132 for bringing the sheet S into close contact with the heating roller 131.

<Concerning Developing Device>

Figure 4:
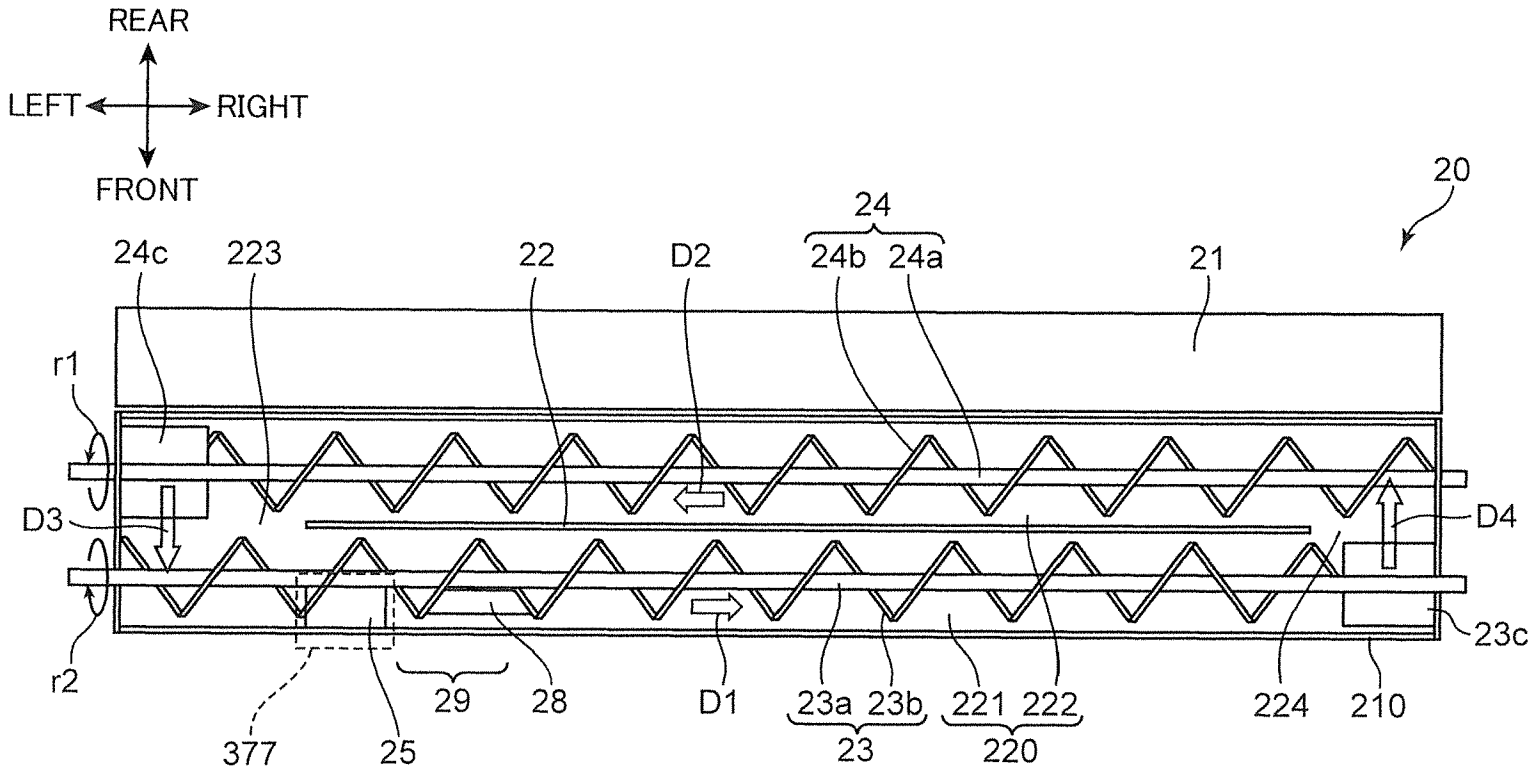
FIG. 4 is a plan view schematically showing an internal structure of a developing device provided in the image forming apparatus.

FIG. 4 is a plan view showing an internal structure of the developing device 20. The developing device 20 includes a development housing 210 having a box shape long in one direction (axial direction of a developing roller 21, lateral direction). The development housing 210 has a storage space 220. The developing roller 21, a first stirring screw 23, a second stirring screw 24 and a toner replenishing port 25 are disposed in the storage space 220. In this embodiment, a one-component development method is applied and a toner is filled as a developer in this storage space 220. On the other hand, in the case of a two-component development method, a mixture of a toner and a carrier made of a magnetic material is filled as a developer. The toner is stirred and conveyed in the storage space 220 and successively supplied from the developing roller 21 to the photoconductive drum 121 to develop an electrostatic latent image.

The developing roller 21 has a cylindrical shape extending in a longitudinal direction (lateral direction) of the development housing 210 and includes a sleeve part, which is rotationally driven, on an outer periphery. The developing roller 21 is a developing member configured to rotate about a shaft at a speed corresponding to a rotating speed of the photoconductive drum 121 and supply the toner to the photoconductive drum 121.

The storage space 220 of the development housing 210 is covered with an unillustrated top board and partitioned into a first conveyance path 221 and a second conveyance path 222 in the lateral direction by a partition plate 22 extending in the lateral direction. The partition plate 22 is shorter than a lateral width of the development housing 210, and a first communication path 223 and a second communication path 224 allowing communication between the first and second conveyance paths 221, 222 are provided at left and right ends of the partition plate 22. In this way, a circulation path composed of the first conveyance path 221, the second communication path 224, the second conveyance path 222 and the first communication path 223 is formed in the storage space 220. The toner is conveyed counterclockwise in FIG. 4 in the circulation path.

The toner replenishing port 25 is an opening open in the top board of the development housing 210, and arranged near and above the left end of the first conveyance path 221. The toner replenishing port 25 is arranged to face the above circulation path and has a function of receiving a replenishing toner supplied through a toner discharge port 377 (FIG. 4) of a toner container 30 in the toner replenishing device 3 into the storage space 220.

The first stirring screw 23 is disposed in the first conveyance path 221. The first stirring screw 23 includes a first rotary shaft 23*a* and a first spiral blade 23*b* spirally projecting on the periphery of the first rotary shaft 23*a*. The first stirring screw 23 conveys the toner in a direction of an arrow D1 of FIG. 4 by being rotationally driven about the first rotary shaft 23*a* (arrow r2). The first stirring screw 23 conveys the toner through a position where the toner replenishing port 25 faces the first conveyance path 221. In this way, the first stirring screw 23 has a function of conveying a new toner flowing in through the toner replenishing port 25 and the toner conveyed into the first conveyance path 221 from the second conveyance path 222 while mixing these toners. A first paddle 23*c* is disposed downstream of the first stirring screw 23 in a toner conveying direction (direction D1). The first paddle 23*c* is rotated together with the first rotary shaft 23*a* and transfers the toner from the first conveyance path 221 to the second conveyance path 222 in a direction of an arrow D4 of FIG. 4.

The second stirring screw 24 is disposed in the second conveyance path 222. The second stirring screw 24 includes a second rotary shaft 24*a* and a second spiral blade 24*b* spirally projecting on the periphery of the second rotary shaft 24*a*. The second stirring screw 24 supplies the toner to the developing roller 21 while conveying the toner in a direction of an arrow D2 of FIG. 4 by being rotationally driven about the second rotary shaft 24*a* (arrow r1). A second paddle 24*c* is disposed downstream of the second stirring screw 24 in a toner conveying direction (direction D2). The second paddle 24*c* is rotated together with the second rotary shaft 24*a* and transfers the toner from the second conveyance path 222 to the first conveyance path 221 in a direction of an arrow D3 of FIG. 4.

The toner replenishing device 3 includes the toner container 30 (developer storage container) arranged above the toner replenishing port 25 of the development housing 210. The toner container 30 includes the toner discharge port 377 (developer discharge port, FIG. 4). The toner discharge port 377 is disposed in a bottom part of the toner container 30 to correspond to the toner replenishing port 25 of the developing device 20. The toner falling from the toner discharge port 377 is replenished into the developing device 20 through the toner replenishing port 25. This toner replenishing device 3 is described in detail later.

Figure 5:
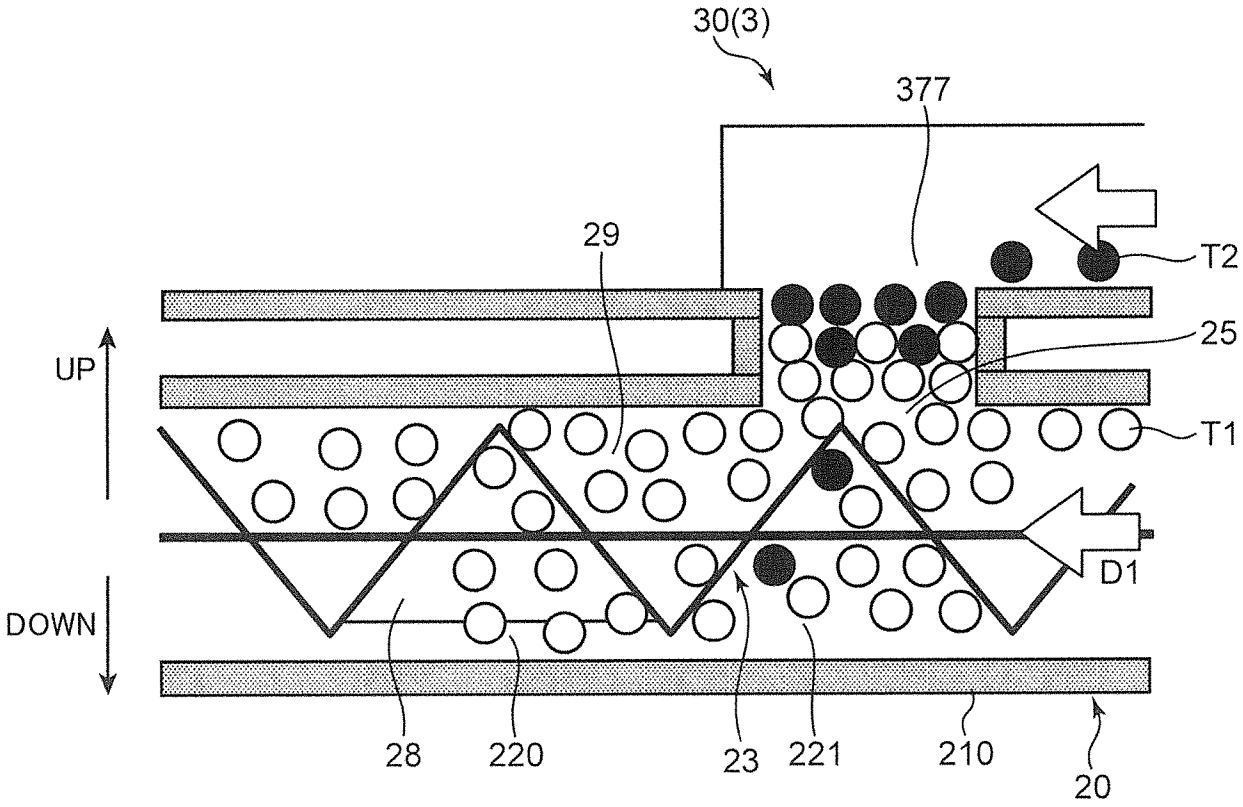
FIG. 5 is a diagram showing a state of replenishing a developer into the developing device.

Next, the flow of toner particles newly replenished through the toner replenishing port 25 is described with reference to FIG. 5. FIG. 5 is a sectional view near the toner replenishing port 25 disposed in the developing device 20 and the toner discharge port 377 disposed in the toner container 30.

Replenishing toner particles T2 supplied through the toner discharge port 377 of the toner container 30 fall into the first conveyance path 221 and are mixed with existing toner particles T1 and conveyed in the direction of the arrow D1 by the first stirring screw 23. At this time, the toner particles T1, T2 are stirred to be charged.

The first stirring screw 23 includes, on a side downstream of the toner replenishing port 25 in the toner conveying direction, a suppression paddle 28 for partially suppressing a toner conveying ability. In this embodiment, the suppression paddle 28 is a plate-like member arranged between adjacent sections of the first spiral blade 23*b* of the first stirring screw 23. By the rotation of the suppression paddle 28 about the first rotary shaft 23*a*, the toner particles conveyed from a side upstream of the suppression paddle 28 start staying. The staying toner particles are accumulated up to a position which is immediately upstream of the suppression paddle 28 and where the toner replenishing port 25 faces the first conveyance path 221. As a result, a staying portion 29 of the toner is formed near an inlet of the toner replenishing port 25. Note that the first spiral blade 23*b* is arranged in an area facing the toner replenishing port 25 (FIG. 4). Further, in another embodiment, a conveying ability suppressing portion may be formed by an area where the first spiral blade 23*b* of the first stirring screw 23 is partially missing and the first rotary shaft 23*a* is partially exposed along an axial direction. Also in this configuration, the conveying ability of the first stirring screw 23 is partially suppressed, wherefore the staying portion 29 of the toner is formed.

When the replenishing toner particles T2 are replenished through the toner replenishing port 25 and the amount of the toner particles in the storage space 220 increases, the toner particles staying in the staying portion 29 close (seal) the toner replenishing port 25 to suppress any further replenishment of the toner particles. Further, the first spiral blade 23*b* pushes the toner in the storage space 220 around the toner replenishing port 25 upwardly by being rotated. As a result, an action to seal the toner replenishing port 25 by the staying portion 29 is increased. Thereafter, when the toner particles in the storage space 220 are consumed by the developing roller 21 and the toner particles staying in the staying portion 29 decrease, the toner particles having closed the toner replenishing port 25 decrease to form a clearance between the staying portion 29 and the toner replenishing port 25. As a result, the replenishing toner particles T2 flow into the storage space 220 through the toner replenishing port 25 again. As just described, a volume replenishment type toner replenishing method of adjusting a receiving amount of the replenishing toner particles T2 as the toner particles staying in the staying portion 29 decrease is adopted in this embodiment. Thus, the toner particles can be replenished into the developing device 20 even without necessarily providing a sensor for detecting a toner amount in the development housing 210 of the developing device 20.

<Concerning Attachment of Toner Container to Developing Device>

Figure 6:
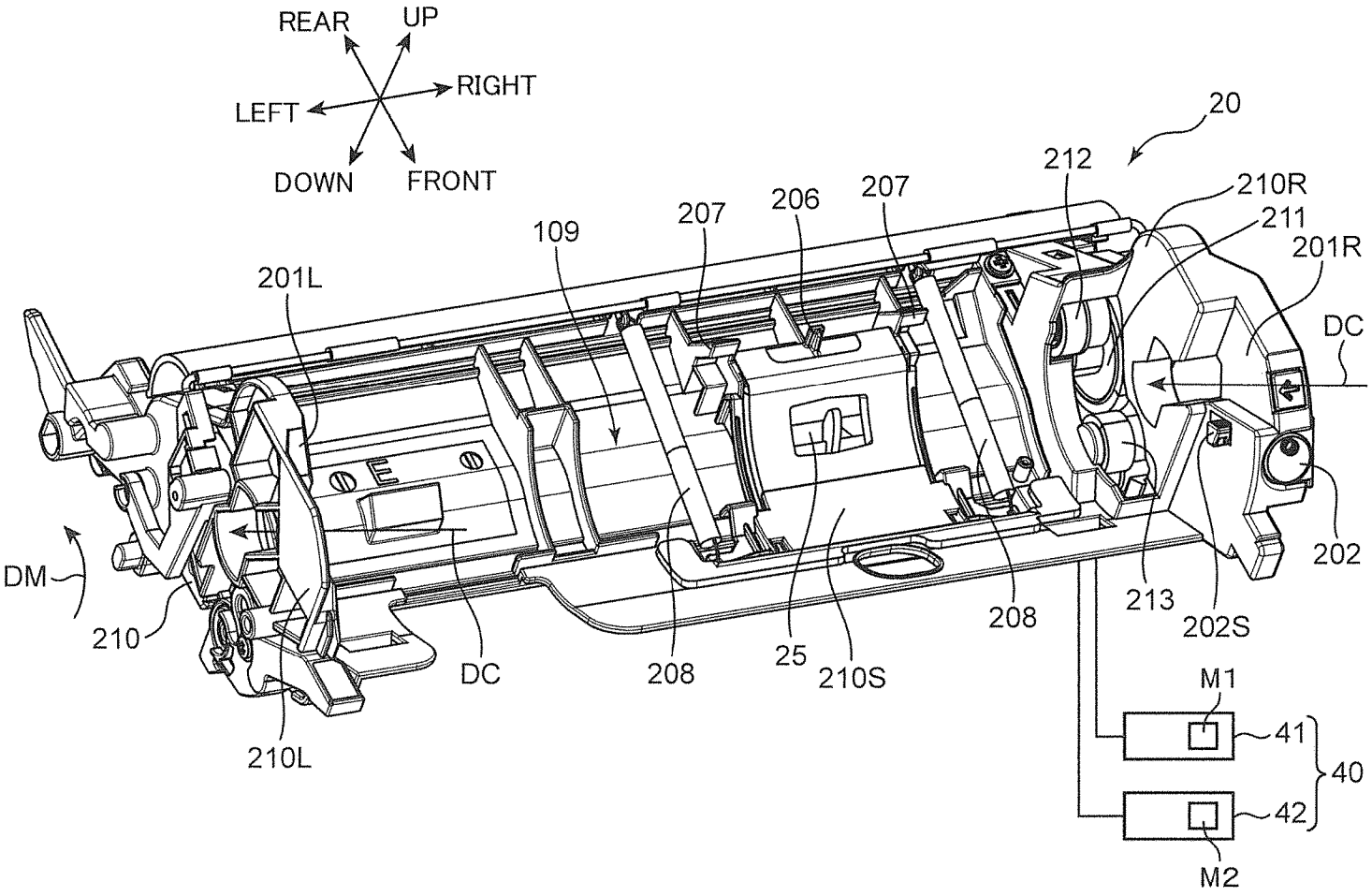
FIG. 6 is a perspective view of the developing device.
Figure 7:
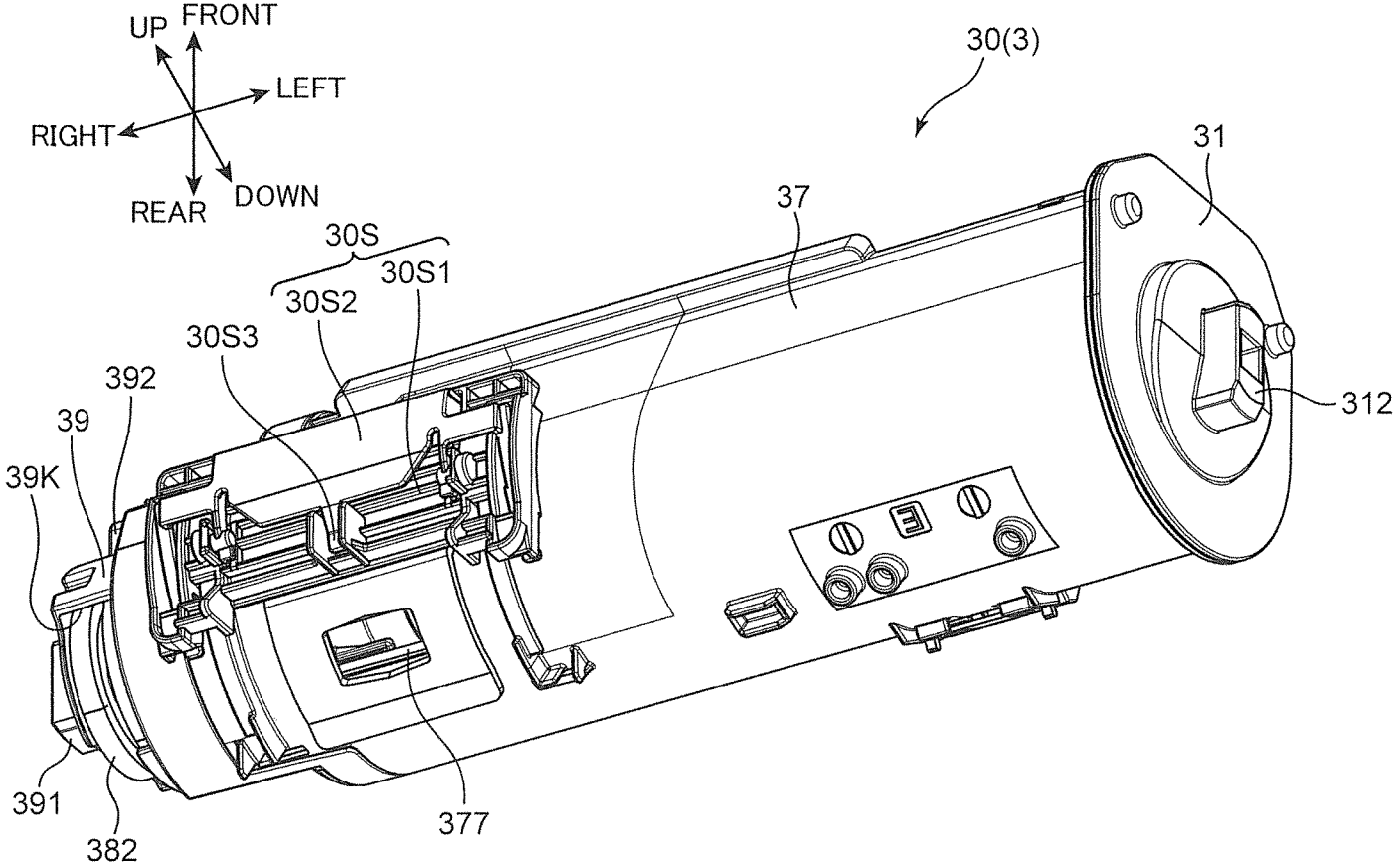
FIG. 7 is a perspective view of a developer storage container provided in a developer replenishing device of the image forming apparatus.

The toner container 30 of the toner replenishing device 3 is detachably attached to the developing device 20 disposed in the internal space 107 of the housing 101. FIGS. 6 and 7 are respectively perspective views of the developing device 20 and the toner container 30 according to this embodiment.

The toner container 30 includes a lid portion 31, a container body 37 (container body), a cover 39 and a container shutter 30S (FIG. 7). The container body 37 is a body part of the toner container 30 and stores the toner inside. The lid portion 31 closes a left end part of the container body 37. The cover 39 is attached to a right end part of the container body 37.

The container shutter 30S is supported slidably with respect to the container body 37. The container shutter 30S has a function of sealing and opening the toner discharge port 377 of the container body 37. The container shutter 30S includes a shutter body 30S1, a shutter locking portion 30S2 and an unlocking portion 30S3.

The shutter body 30S1 is a body part of the container shutter 30S and has a function of sealing and opening the toner discharge port 377. The shutter body 30S1 is supported slidably with respect to the container body 37. The shutter locking portion 30S2 is supported swingably with respect to the shutter body 30S1. The shutter locking portion 30S2 has a function of allowing and restricting a sliding movement of the shutter body 30S1 with respect to the container body 37. The unlocking portion 30S3 is a projecting piece provided on the shutter locking portion 30S2. When the unlocking portion 30S3 is pressed, an unillustrated lock piece provided on the shutter locking portion 30S2 is disengaged from an engaging portion formed on the container body 37 to enable a sliding movement of the shutter body 30S1.

With reference to FIG. 1, when the upper cover 102B of the housing 101 is opened upwardly and the front cover 104 is opened forwardly, a container mounting portion 109 provided in the development housing 210 of the developing device 20 is exposed to the outside of the housing 101. With reference to FIG. 6, the development housing 210 includes a pair of a housing left wall 210L and a housing right wall 210R. The container mounting portion 109 is formed between the housing left wall 210L and the housing right wall 210R. In this embodiment, the toner container 30 is obliquely mounted into the container mounting portion 109 from above (see arrow DC of FIG. 6). At this time, the cover 39 of the toner container 30 is arranged on the side of the housing right wall 210R, and the lid portion 31 of the toner container 30 is arranged on the side of the housing left wall 210L. The development housing 210 includes a left guide groove 201L and a right guide groove 201R.

The left guide groove 201L and the right guide groove 201R are respectively groove portions formed in the housing left wall 201L and the housing right wall 201R. The left and right guide grooves 201L, 201R guide the mounting of the toner container 30 into the container mounting portion 109. Thus, entrance sides of the left and right guide grooves 201L, 201R are formed to extend along a mounting direction (direction of an arrow DC of FIG. 6) of the toner container 30. On the other hand, back sides of the left and right guide grooves 201L, 201R have a fan shape to allow the rotation of a first guide portion 312 (FIG. 7) and a second guide portion 391 (FIG. 7).

Further, with reference to FIG. 6, the developing device 20 includes a first transmission gear 211, a second transmission gear 212 and a third transmission gear 213. Further, although described in detail later, the toner replenishing device 3 is provided with a container driving unit 40 including a moving wall driver 41 and a rotary body driver 42. The first, second and third transmission gears 211, 212 and 213 are gears rotatably supported on the housing right wall 210R. The first transmission gear 211 is coupled to the second transmission gear 212. Further, the first transmission gear 211 is coupled to the developing roller 21, the first stirring screw 23 and the second stirring screw 24 via an unillustrated gear group. When the developing device 20 is mounted into the housing 101, a moving wall drive motor M1 of the moving wall driver 41 is coupled to the third transmission gear 213 and a rotary body drive motor M2 of the rotary body driver 42 is coupled to the first transmission gear 211.

The moving wall drive motor M1 moves a later-described moving wall 32 of the toner container 30 by rotating a later-described shaft 33 of the toner container 30 in a direction DM in FIG. 6 via the third transmission gear 213. Specifically, the third transmission gear 213 is engaged with a later-described shaft drive gear 382 of the moving wall driver 41 to transmit a drive force of the moving wall drive motor M1 to the shaft drive gear 382. The rotary body drive motor M2 rotates a later-described rotary body 35 of the toner container 30 via the first and second transmission gears 211 and 212. Further, the rotary body drive motor M2 rotates the developing roller 21, the first stirring screw 23 and the second stirring screw 24 of the developing device 20 via the first transmission gear 211.

Further, the development housing 210 includes an unlocking button 202, the aforementioned toner replenishing port 25, a releasing projection 206, a pair of container shutter fixing portions 207, a pair of shutter springs 208 and a housing shutter 210S.

The unlocking button 202 is a press button slidably supported on the housing right wall 210R. The unlocking button 202 has a function of locking or unlocking the posture of the toner container 30 mounted in the container mounting portion 109. The unlocking button 202 includes a lock engaging piece 202S. The lock engaging piece 202S is a claw part formed to project toward the container mounting portion 109 on a front part of the housing right wall 210R. Further, the developing device 20 includes an unillustrated lock biasing spring. The lock biasing spring is a coil spring arranged inside the housing right wall 210R to bias the unlocking button 202 forward. The lock engaging piece 202S has a function of locking the posture of the toner container 30 mounted in the container mounting portion 109. On the other hand, when the unlocking button 202 is pressed against a biasing force of the lock biasing spring, the lock engaging piece 202S is separated from the toner container 30 to release the locking function for the toner container 30.

The aforementioned toner replenishing port 25 is an opening having a substantially rectangular shape and open in the top board of the development housing 210 (FIG. 6). The toner replenishing port 25 communicates with the inside of the development housing 210. Further, the toner replenishing port 25 is arranged to face the toner container 30 mounted in the container mounting portion 109. The toner discharged through the toner discharge port 377 of the toner container 30 flows into the development housing 210 through the toner replenishing port 25.

The unlocking projection 206 is a projection provided behind and adjacent to the toner replenishing port 25 and projecting from the top board of the development housing 210. The unlocking projection 206 has a function of pressing the unlocking portion 30S3 (FIG. 7) of the container shutter 30S of the toner container 30 when the toner container 30 is mounted into the container mounting portion 109. In other words, the unlocking projection 206 allows a sliding movement of the container shutter 30S.

The pair of container shutter fixing portions 207 are projections projecting from the top board of the development housing 210 at both sides of the unlocking projection 206 in the lateral direction. In a cross-section intersecting the lateral direction, the container shutter fixing portion 207 has a substantially trapezoidal shape. Further, a front side surface of the container shutter fixing portion 207 is formed with a wedge-shaped notch. When the toner container 30 is mounted into the container mounting portion 109, this notch is engaged with a part of the container shutter 30S of the toner container 30. As a result, the container shutter fixing portions 207 fix the container shutter 30S and restrict a movement (rotation) of the container shutter 30S.

The pair of shutter springs 208 are a pair of spring members arranged outwardly of the pair of container shutter fixing portions 207 in the lateral direction. The shutter springs 208 are arranged to extend in a front-rear direction. Rear end parts of the pair of shutter springs 208 are respectively engaged to the top board of the development housing 210. Further, front end parts of the pair of shutter springs 208 are respectively engaged to both left and right end parts of the housing shutter 210S.

The housing shutter 210S is supported on the development housing 210 slidably with respect to the toner replenishing port 25. The housing shutter 210S seals or opens the toner replenishing port 25.

The aforementioned pair of shutter springs 208 bias the housing shutter 210S in such a direction that the housing shutter 210S seals the toner replenishing port 25. When the toner container 30 is detached from the developing device 20, the housing shutter 210S seals the toner replenishing port 25 by receiving biasing forces of the pair of shutter springs 208.

Further, when the toner container 30 is mounted into the container mounting portion 109, the housing shutter 210S can press the container body 37 of the toner container 30. Thus, the shutter springs 208 bias the toner container 30 mounted in the container mounting portion 109 via the housing shutter 210S in such a direction that the housing shutter 210S closes the toner replenishing port 25.

<Concerning Toner Replenishing Device>

Next, the toner replenishing device 3 is described. As described above, the toner replenishing device 3 is a device for replenishing the toner into the developing device 20 and includes the toner container 30 (developer storage container) arranged above the toner replenishing port 25 of the development housing 210.

(Toner Container)

Figure 8:
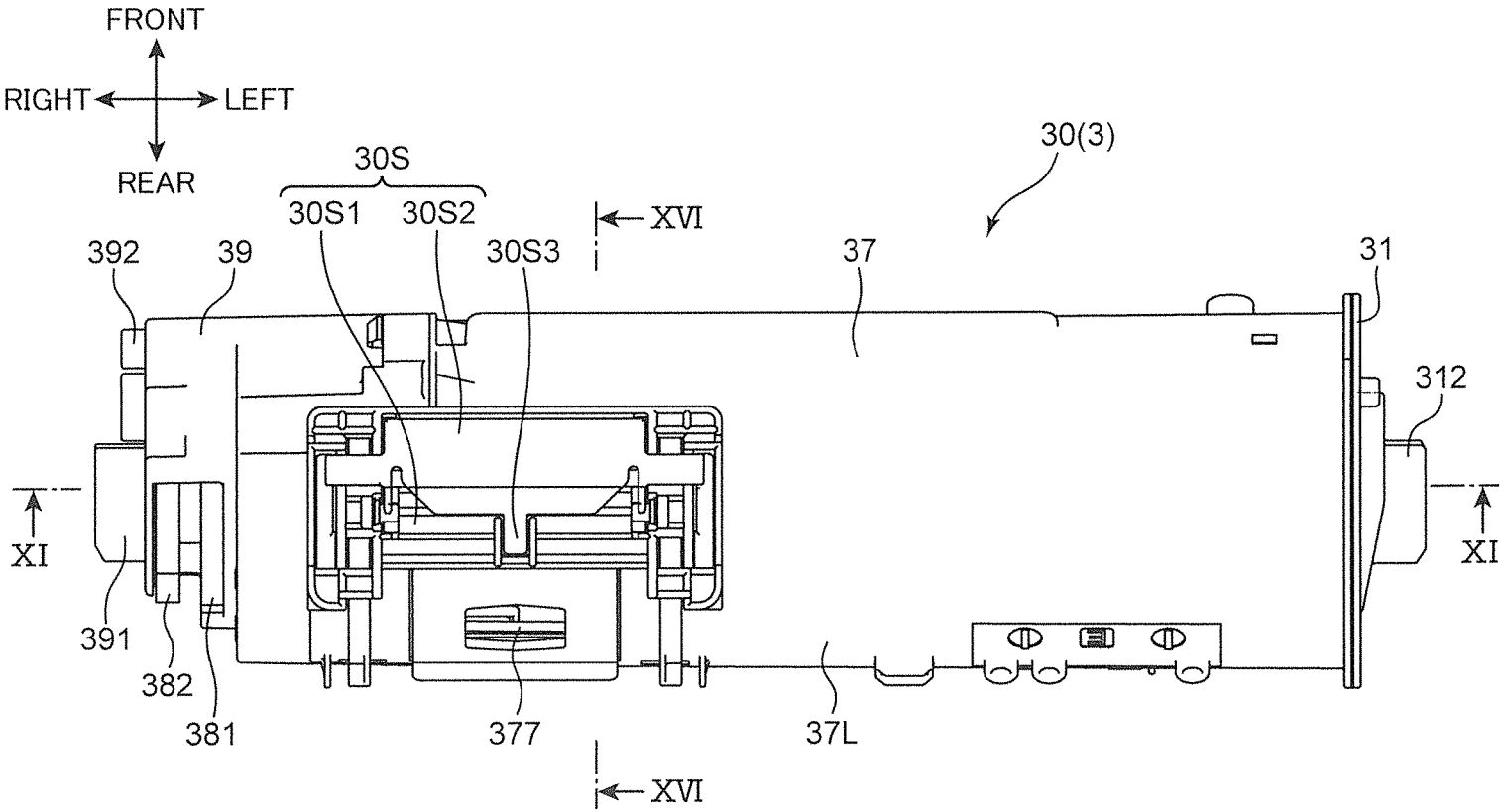
FIG. 8 is a plan view of the developer storage container.
Figure 9:
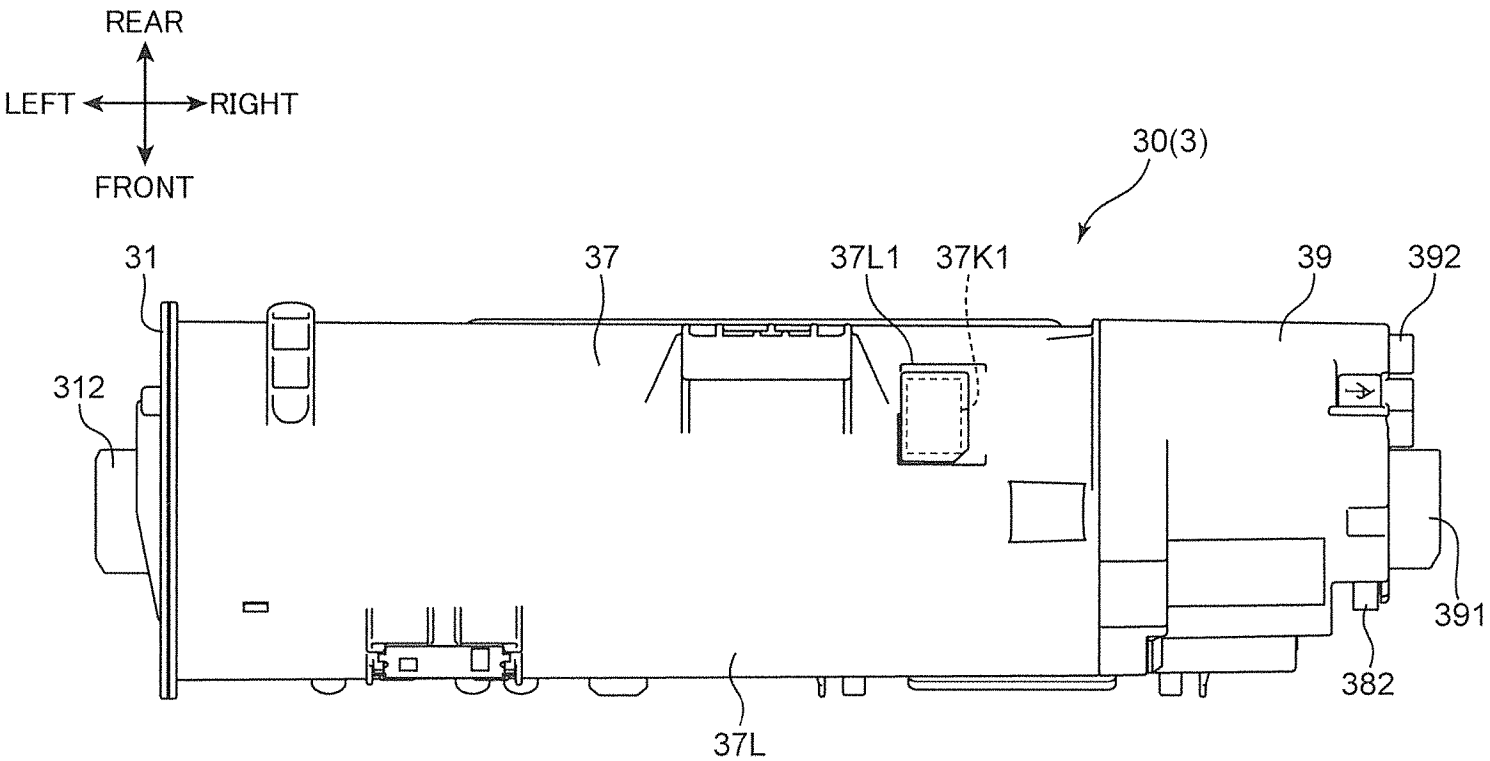
FIG. 9 is a plan view of the developer storage container.
Figure 10:
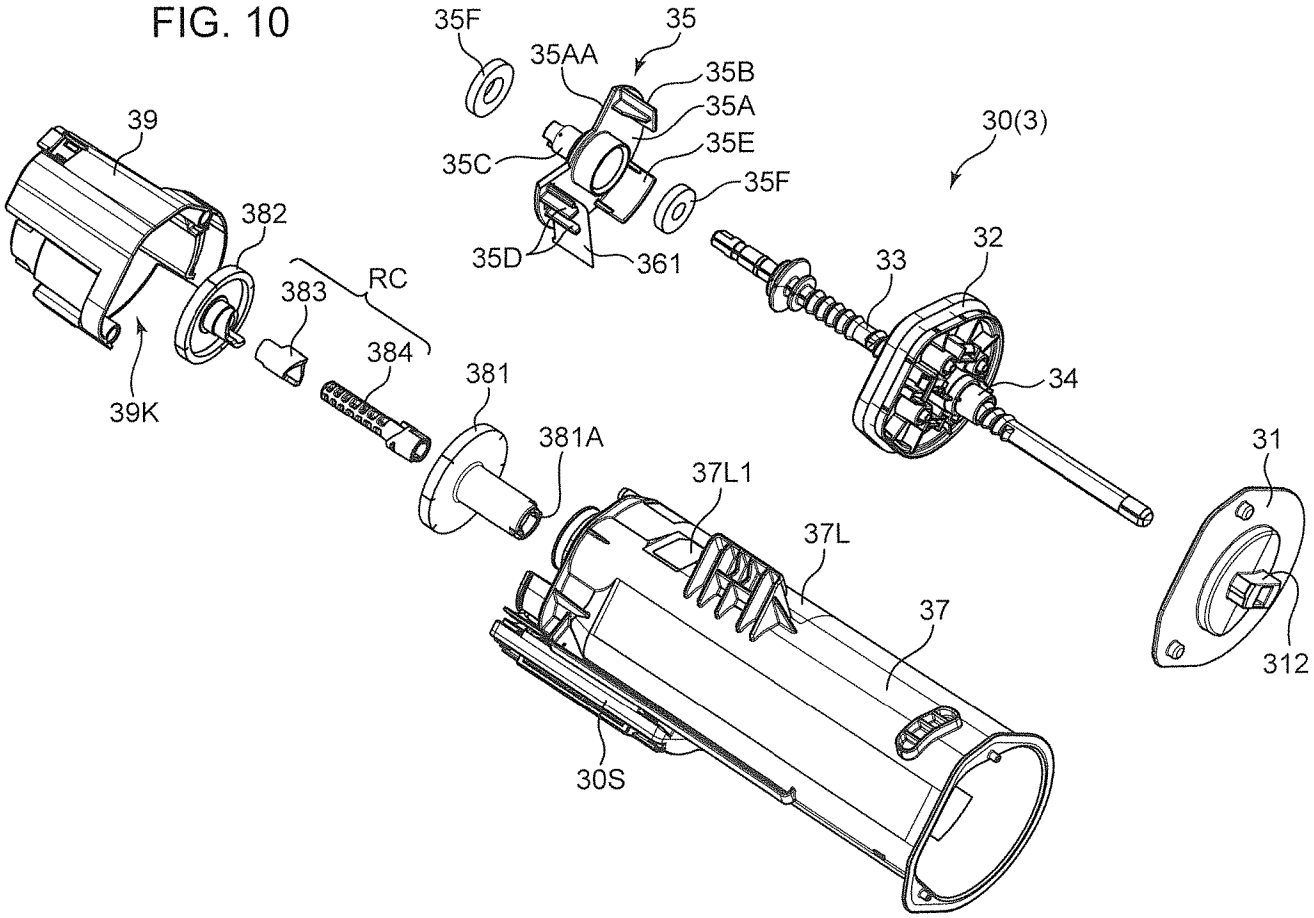
FIG. 10 is an exploded perspective view of the developer storage container.
Figure 11:
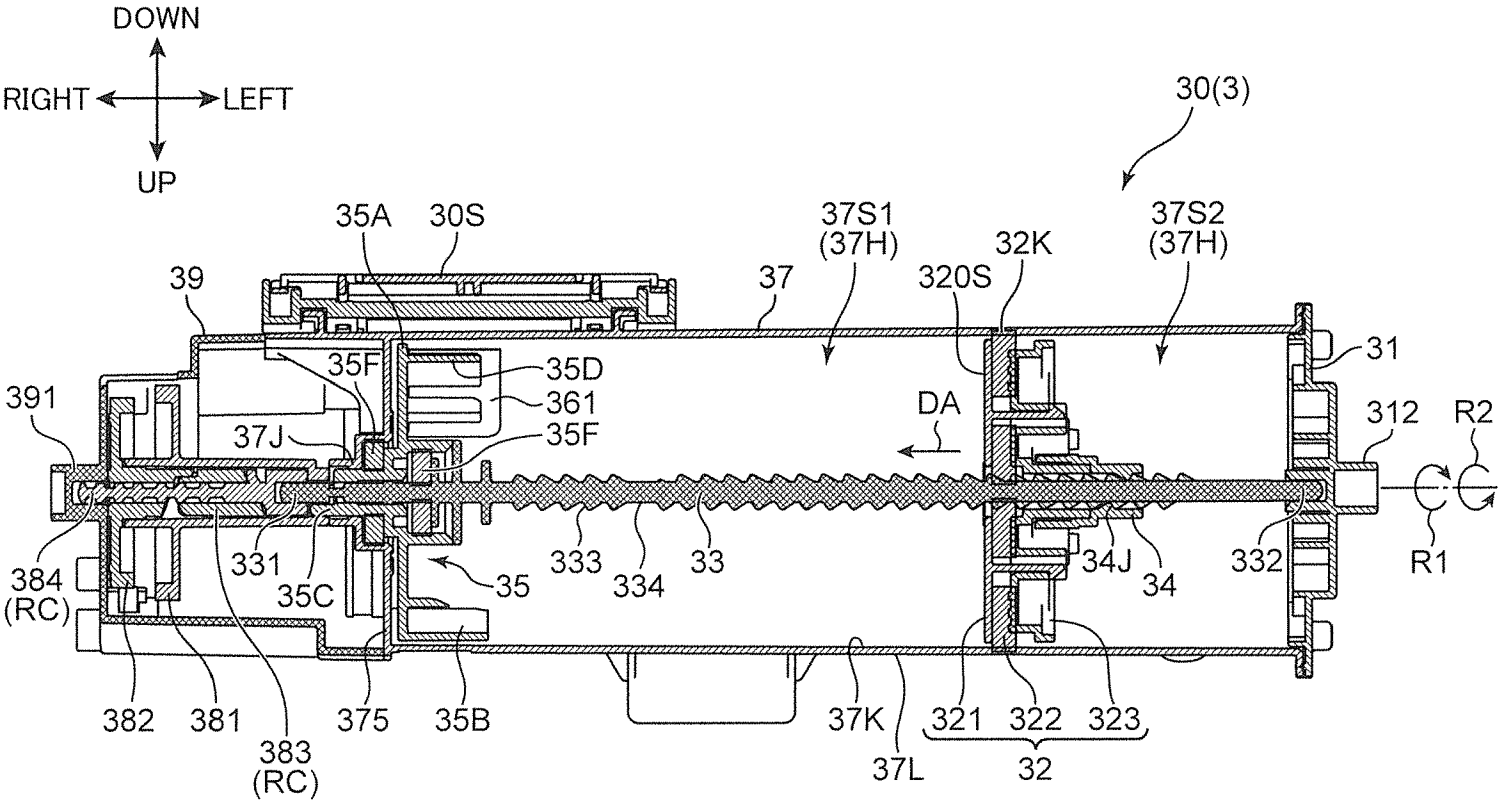
FIG. 11 is a sectional view along line XI-XI of FIG. 8.

The toner container 30 is described with reference to FIGS. 8 to 11 in addition to FIG. 7. FIGS. 8 and 9 are plan views of the toner container 30. FIG. 10 is an exploded perspective view of the toner container 30. FIG. 11 is a sectional view along section line XI-XI of the toner container 30 of FIG. 8. The toner container 30 has a tubular shape extending in the lateral direction (first direction, direction of an arrow DA of FIG. 11). The toner container 30 stores the replenishing toner (developer) inside. The toner container 30 includes the moving wall 32, the shaft 33, a pressing member 34, the rotary body 35, a rotary body drive gear 381, the shaft drive gear 382, a ratchet gear 383 and a ratchet shaft 384 in addition to the aforementioned lid portion 31, container body 37 (container body) and cover 39.

The lid portion 31 is fixed to the container body 37 to seal an opening of the container body 37. The lid portion 31 rotatably supports a second shaft end part 332 (FIG. 11) of the shaft 33. The lid portion 31 includes the first guide portion 312. The first guide portion 312 is a projection formed to extend in the vertical direction on a left side surface (outer surface part) of the lid portion 31. The first guide portion 312 has a function of guiding the attachment of the toner container 30 to the developing device 20.

The container body 37 is a tubular body part of the toner container 30. The container body 37 includes a right wall 375 (FIG. 11), a projecting wall 376 (see FIG. 20 to be described later) and a storage space 37H extending in a first direction DA (lateral direction) and capable of storing the toner. The right wall 375 is a wall portion arranged on one end side (right end side) of the container body 37 in the first direction DA and configured to close the inside of the container body 37. Note that the storage space 37H is a space defined by an inner peripheral surface 37K formed by the container body 37 and further by the right wall 375 and the lid portion 31. Further, an area of the storage space 37H between the right wall 32 and the moving wall 32 serves as a first space 37S1 and an area between the moving wall 32 and the lid portion 31 serves as a second space 37S2. The first space 37S1 is a space where the toner is stored, in the storage space 37H of the toner container 30. On the other hand, the second space 37S2 is a space where the toner is not stored, in the storage space 37H of the toner container 30.

As shown in FIG. 11, a side of the container body 37 opposite to the right wall 375 in the first direction DA is an opening. When the lid portion 31 is fixed in this opening, the lid portion 31 closes the storage space 37H of the container body 37. Note that an outer peripheral edge of the lid portion 31 is ultrasonically welded to the container body 37.

Figure 20:
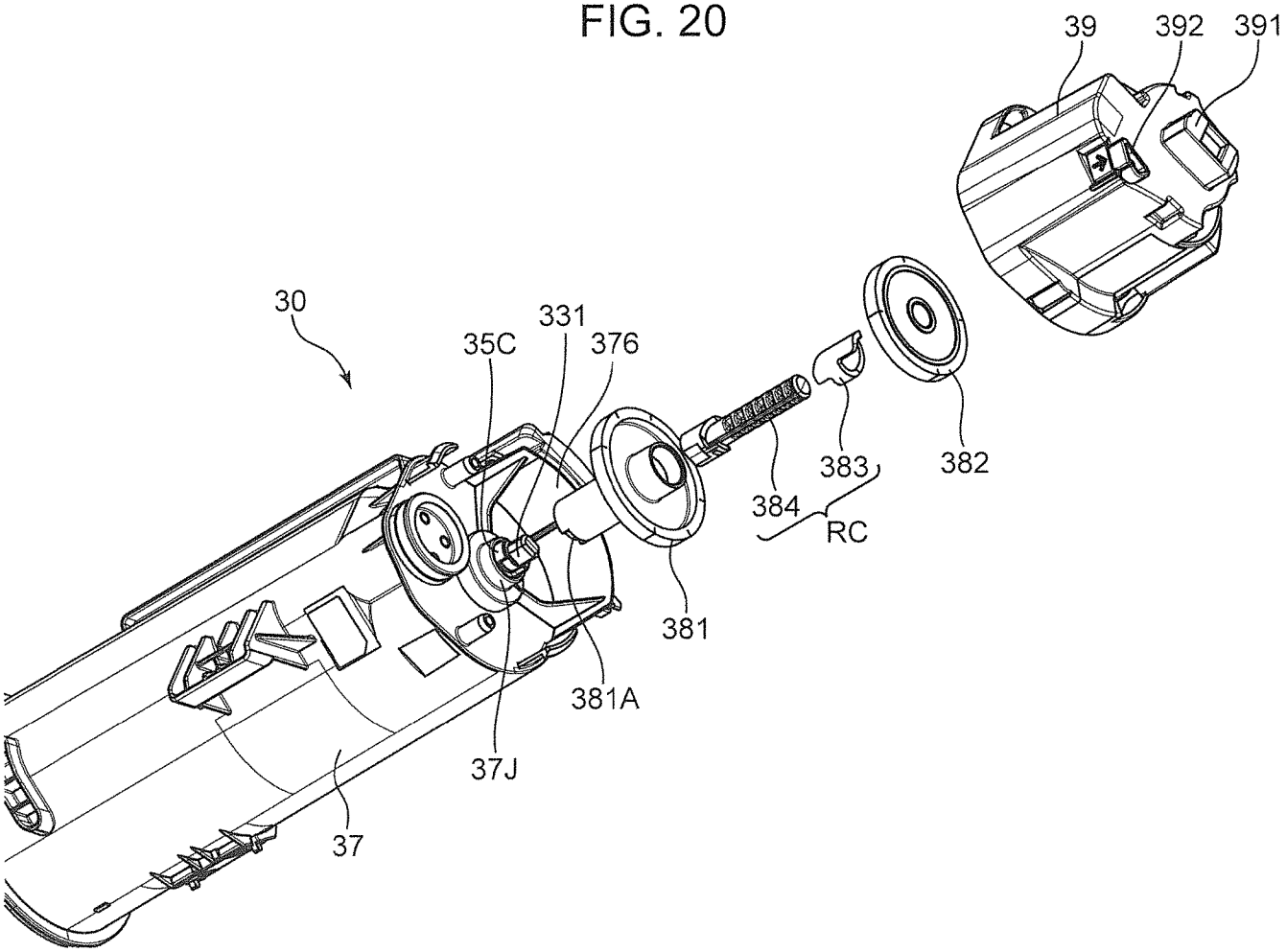
FIG. 20 is an exploded perspective view of the developer storage container showing a ratchet mechanism.

With reference to FIG. 20 to be described later, the projecting wall 376 is a part of an outer peripheral surface 37L of the container body 37 projecting further rightward than the right wall 375. The cover 39 is mounted on the projecting wall 376. The cover 39 has a function of exposing circumferential parts of the rotary body drive gear 381 and the shaft drive gear 382 to outside and covering the other circumferential parts of the rotary body drive gear 381 and the shaft drive gear 382. The cover 39 includes the aforementioned second guide portion 391 (see FIG. 11), a container engaging portion 392 and a gear opening 39K (see FIG. 7).

The second guide portion 391 is a projection projecting rightward along the vertical direction on a right side surface of the cover 39. The second guide portion 391 has a function of guiding the attachment of the toner container 30 to the developing device 20 together with the first guide portion 312 of the lid portion 31. The container engaging portion 392 is a projection provided on the right side surface of the cover 39 at a distance from the second guide portion 391. The lock engaging piece 202S of the unlocking button 202 is engageable with the container engaging portion 392.

The gear opening 39K is an opening open in a lower surface part of the cover 39 and having a semicircular shape. When the cover 39 is attached to the container body 37, some of gear teeth of the rotary body drive gear 381 and the shaft drive gear 382 are exposed to the outside of the toner container 30 via the gear opening 39K. As a result, when the toner container 30 is mounted into the development housing 210 of the developing device 20, the rotary body drive gear 381 and the shaft drive gear 382 are respectively engaged with the second and third transmission gears 212, 213 (FIG. 6).

Further, the container body 37 includes the aforementioned toner discharge port 377 (developer discharge port) and a body bearing portion 37J (FIG. 11). The toner discharge port 377 is open in a lower surface part of a right end part (one end part in the first direction DA) of the container body 37 to communicate with the storage space 37H. In other words, the toner discharge port 377 is arranged adjacent to the right wall 375 in the first direction DA. Further, the toner discharge port 377 is a rectangular opening having a predetermined length along the first direction DA and a predetermined width along an arcuate shape of a lower surface part of the container body 37. In this embodiment, the toner discharge port 377 is open at a position deviated rearward and upward along a circumferential direction from a lower end part of the lower surface part of the container body 37. The toner discharge port 377 allows the toner to be discharged from the first space 37S1 toward the developing device 20.

The body bearing portion 37J (FIG. 11) is a bearing formed in the right wall 375. The shaft 33 is inserted through the body bearing portion 37J. At this time, a right end side (first shaft end part 331) of the shaft 33 projects outwardly of the container body 37.

The shaft 33 is arranged to extend in the first direction DA in the storage space 37H. The shaft 33 is rotatably supported on the right wall 375 of the container body 37 and the lid portion 31. The shaft 33 includes the first shaft end part 331, the second shaft end part 332, an externally threaded portion 333 and a moving wall stopping portion 334.

With reference to FIG. 11, the first shaft end part 331 is a tip part of the shaft 33 projecting rightward through the body bearing portion 37J. A pair of D surfaces are formed on the peripheral surface of the first shaft end part 331 (see FIG. 20). The ratchet shaft 384 constituting a ratchet mechanism RC to be described later is engaged with the first shaft end part 331. As a result, the shaft 33 and the ratchet shaft 384 are integrally rotatable. The second shaft end part 332 is a left end part of the shaft 33. The second shaft end part 332 is rotatably supported in a bearing hole formed in the lid portion 31 as described above.

The externally threaded portion 333 is a spirally threaded portion formed along the first direction DA on the outer peripheral surface of the shaft 33 in the storage space 37H. In this embodiment, the externally threaded portion 333 is arranged from an area of the shaft 33 adjacent to the lid portion 31 to an area upstream of the toner discharge port 377 in the first direction DA as shown in FIG. 11.

The moving wall stopping portion 334 is continuously arranged on a side downstream of the externally threaded portion 333 in the first direction DA. The moving wall stopping portion 334 is an area formed only of a shaft part where the externally threaded portion 333 is partially missing on the shaft 33 in the storage space 37H. The moving wall stopping portion 334 is located above the toner discharge port 377 and upstream of the toner discharge port 377 in the first direction DA.

The moving wall 32 partitions the storage space 37H of the container body 37 into the first space 37S1 where the toner is stored and the second space 37S2 where the toner is not stored. The moving wall 32 to which the shaft 33 is inserted and moves in the first direction DA along the shaft 33 by the rotation of the shaft 33 in a first rotating direction R1 (see FIG. 11) about an axis extending in the first direction DA. In this way, the moving wall 32 conveys the toner in the first space 37S1 toward the toner discharge port 377. In this embodiment, the moving wall 32 receives a drive force from the pressing member 34 according to the rotation of the shaft 33. The pressing member 34 is arranged upstream of the moving wall 32 in the first direction DA. The pressing member 34 is a tubular member for allowing the passage of the shaft 33 through the inside thereof and has a function of pressing the moving wall 32 in the first direction DA. An internally threaded portion 34J is formed on the inner peripheral surface of the pressing member 34. The pressing member 34 moves the moving wall 32 toward the toner discharge port 377 in the first direction DA by the engagement of the externally threaded portion 333 of the shaft 33 and the internally threaded portion 34J of the pressing member 34.

The moving wall 32 moves in the first direction DA in the storage space 37H from an initial position on one end side to a final position on the other end side in the first direction DA while conveying the toner in the first space 37S1 toward the toner discharge port 377 from the start to the end of use of the toner container 30. The initial position of the moving wall 32 is arranged to the right (downstream in the first direction DA) of the lid portion 31 and the final position is arranged immediately to the left (upstream in the first direction DA) of the toner discharge port 377.

Figure 12:
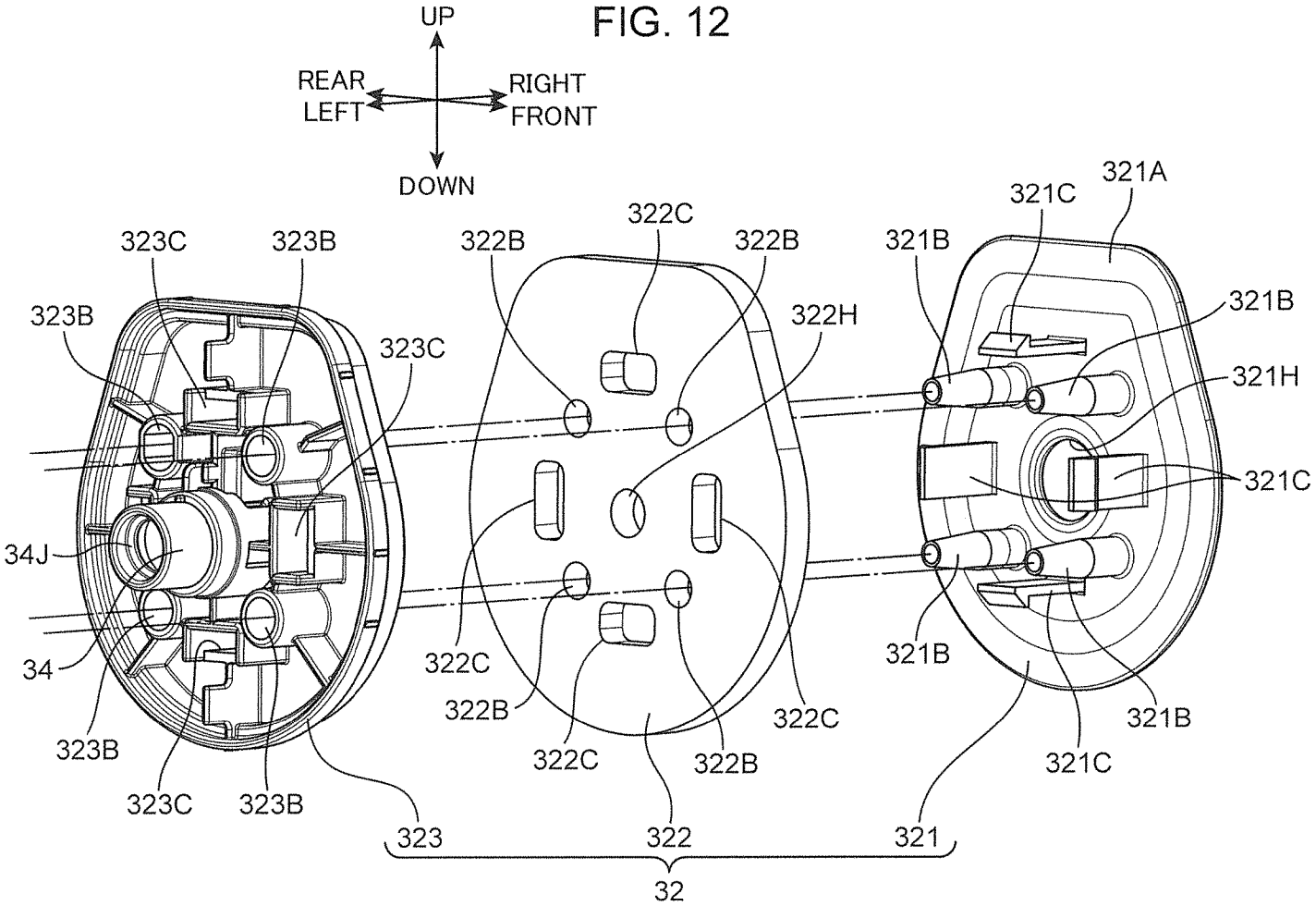
FIG. 12 is an exploded perspective view of a moving wall of the developer storage container.
Figure 13:
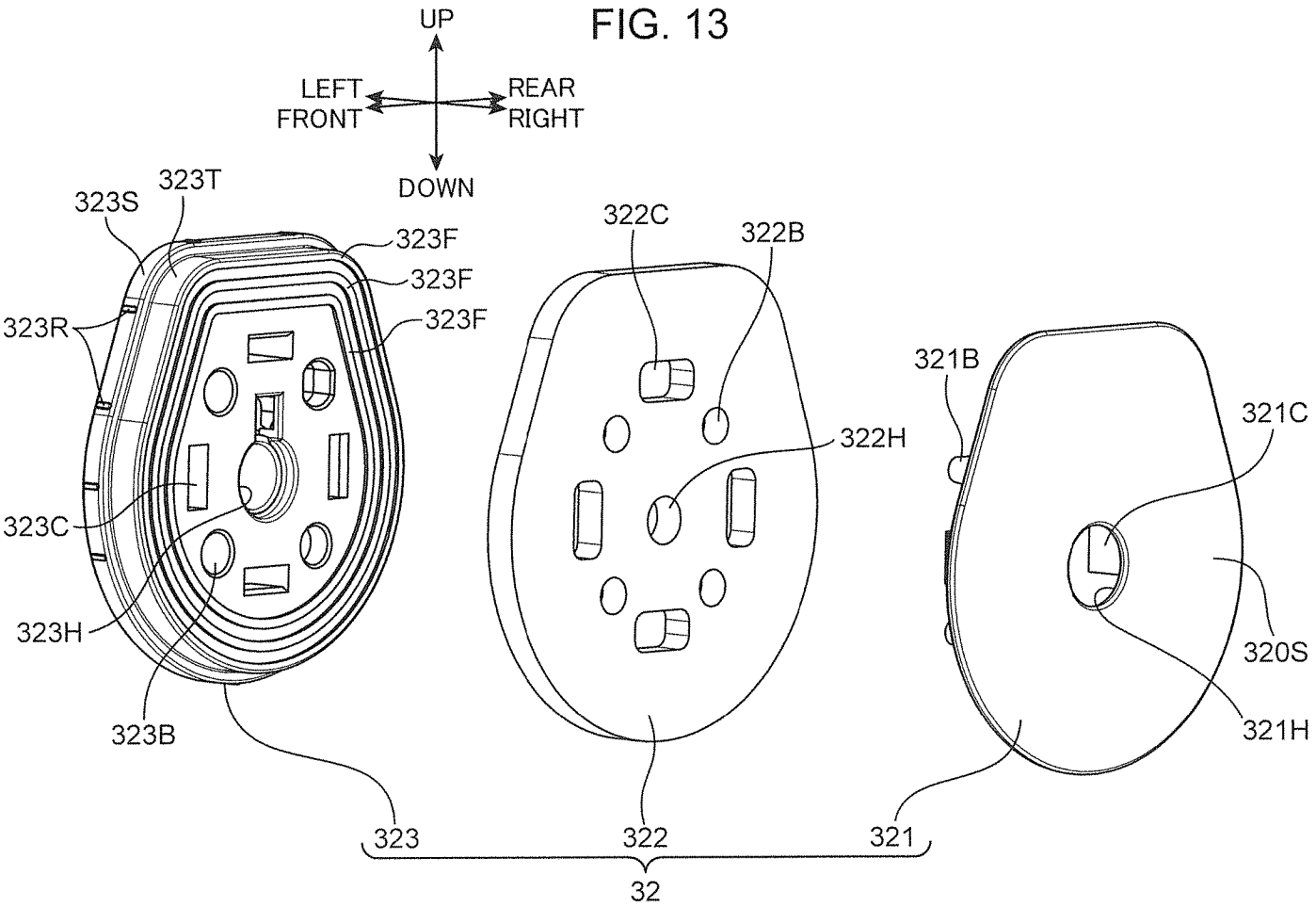
FIG. 13 is an exploded perspective view of the moving wall of the developer storage container.
Figure 14:
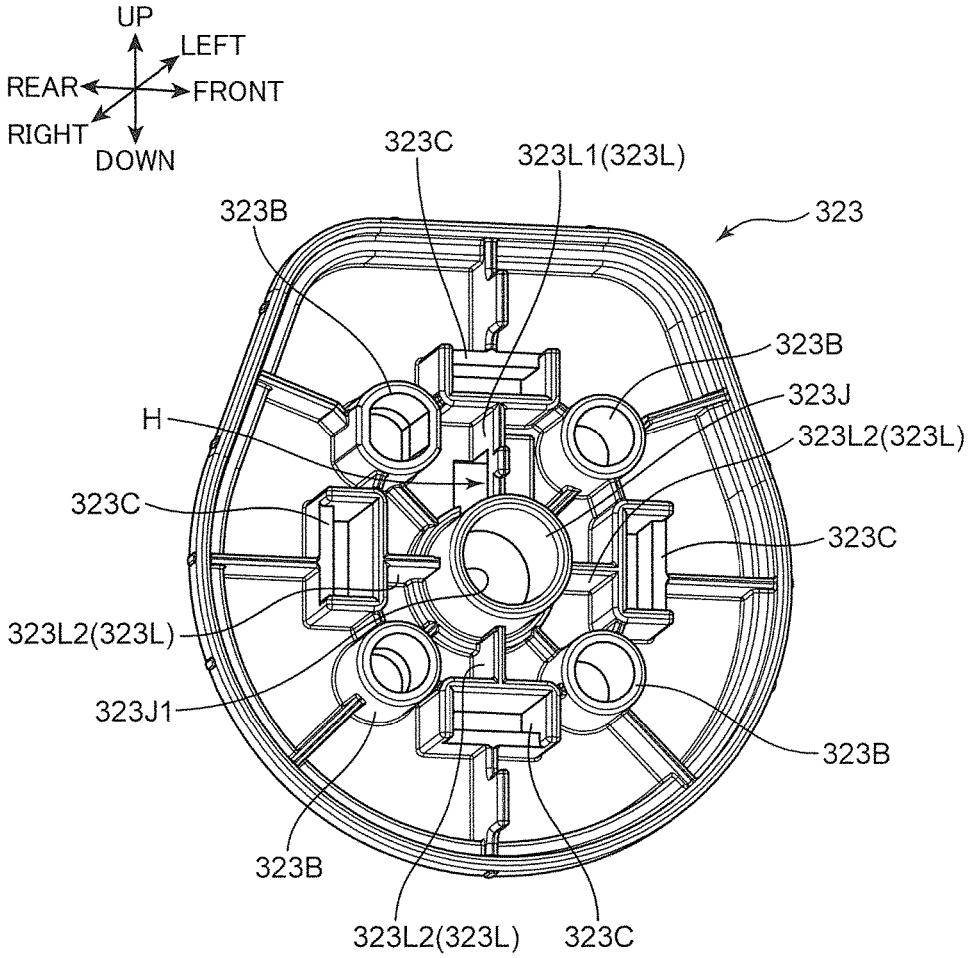
FIG. 14 is a perspective view of a wall body portion of the moving wall.
Figure 15:
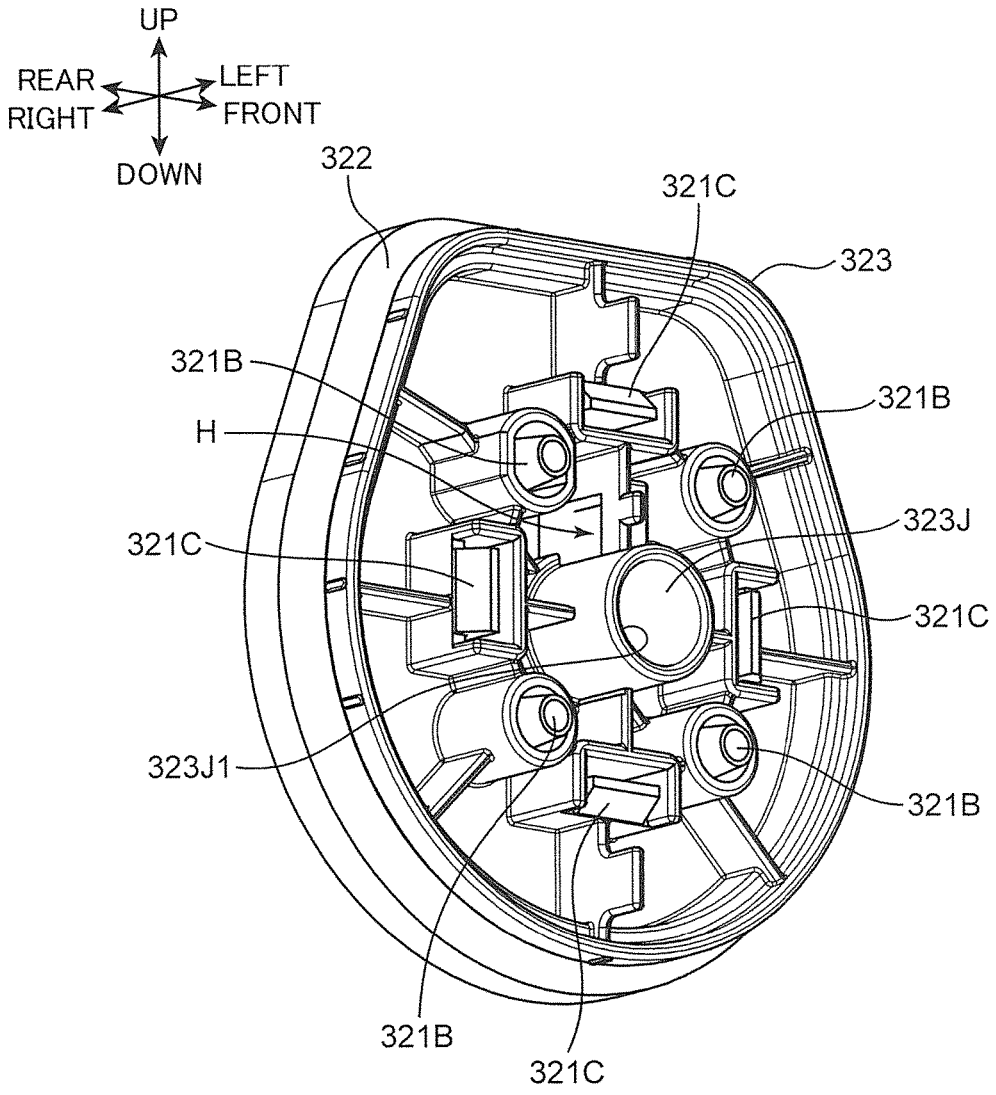
FIG. 15 is a perspective view of the moving wall.

With reference to FIGS. 12 to 15, a detailed structure of the moving wall 32 is described below. FIGS. 12 and 13 are exploded perspective views of the moving wall 32 respectively viewed from different viewpoints. Note that the pressing member 34 is also shown in FIG. 12. FIG. 14 is a perspective view of a wall body portion 323 of the moving wall 32. FIG. 15 is a perspective view of the moving wall 32.

The moving wall 32 includes a wall plate 321, a seal member 322 and the wall body portion 323. In other words, the moving wall 32 is composed of three plate-like members in this embodiment. Note that outer peripheral parts of the wall plate 321, the seal member 322 and the wall body portion 323 are similarly shaped to each other. Specifically, a lower end part of the moving wall 32 has an arcuate shape projecting downward, an upper end part of the moving wall 32 is formed by a horizontal flat part and both side parts of the moving wall 32 are formed by inclined parts connecting the above arcuate shape and flat part.

The wall plate 321 is arranged on a most downstream side of the moving wall 32 in the first direction DA. The wall plate 321 is formed by resin molding. The wall plate 321 includes a plate body 321A, four studs 321B and four engaging pieces 321C. The plate body 321A is a plate-like body part of the wall plate 321 and facing in the lateral direction. A plate shaft hole 321H is open in a central part of the plate body 321A. The shaft 33 is inserted through the plate shaft hole 321H. Further, a right side surface of the plate body 321A constitutes a conveying surface 320S. The conveying surface 320S defines the first space 37S1 for storing the toner together with the inner peripheral surface 37K of the container body 37. Further, the conveying surface 320S conveys the toner in the first space 37S1 while pressing the toner according to a movement of the moving wall 32.

Each of the four studs 321B projects leftward (toward the wall body portion 323) from a left side surface of the plate body 321A. The stud 321B has a cylindrical shape and a tip part thereof is tapered. In this embodiment, two studs 321B are arranged at a distance in the front-rear direction above the plate shaft hole 321H, and two studs 321B are arranged at a distance in the front-rear direction below the plate shaft hole 321H. The four studs 321B have a function of positioning the wall plate 321 with respect to the wall body portion 323.

Each of the four engaging pieces 321C projects leftward from the left side surface of the plate body 321A similarly to the studs 321B. The engaging piece 321C is hook-shaped and a tip part thereof is claw-shaped. In this embodiment, one engaging piece 321C is arranged right above the plate shaft hole 321H, two engaging piece 321C are arranged before and behind the plate shaft hole 321H and one engaging piece 321C is arranged below the plate shaft hole 321H. In other words, the four engaging pieces 321C are respectively arranged between adjacent ones of the four studs 321B in a circumferential direction. The four engaging pieces 321C have a function of fixing the wall plate 321 to the wall body portion 323.

The seal member 322 is arranged at a position in a central part of the moving wall 32 in the first direction DA to be sandwiched between the wall plate 321 and the wall body portion 323. The seal member 322 is formed of a urethane material having a predetermined thickness in the first direction DA. A seal shaft hole 322H is open in a central part of the seal member 322. The shaft 33 is inserted through the seal shaft hole 322H. Four stud insertion holes 322B and four engaging piece insertion holes 322C are respectively open around the seal shaft hole 322H in the seal member 322. The four stud insertion holes 322B allow the respective four studs 321B described above to pass therethrough. Similarly, the four engaging piece insertion holes 322C allow the respective four engaging pieces 321C described above to pass therethrough. As a result, the position of the seal member 322 with respect to the wall plate 321 and the wall body portion 323 of the moving wall 32 is restricted. In other words, the seal member 322 is restrained in the vertical and lateral directions. Note that an outer peripheral part of the seal member 322 constitutes an outer peripheral surface 32K of the moving wall 32 (see FIG. 11). The outer peripheral surface 32K is arranged in contact with the inner peripheral surface 37K of the container body 37 and compressively deformed.

The wall body portion 323 is arranged on a side upstream of the wall plate 321 and the seal member 322 in the first direction DA, i.e. on a most upstream side of the moving wall 32 in the first direction DA. The wall body portion 323 is formed by resin molding. As shown in FIG. 13, the wall body portion 323 includes a large diameter portion 323S and a small diameter portion 323T. Specifically, the wall body portion 323 has a stepped shape along the first direction DA so that a downstream side in the first direction DA (small diameter portion 323T) is one size smaller than an upstream side in the first direction DA (large diameter portion 323S). A hollow cylindrical portion 323J is arranged in a central part of the wall body portion 323 (FIG. 14). The hollow cylindrical portion 323J has a hollow cylindrical shape projecting toward an upstream side in the first direction DA from the wall body portion 323. A wall body shaft hole 323H is formed in the hollow cylindrical interior of the hollow cylindrical portion 323J (FIG. 13). The shaft 33 is inserted through the wall body shaft hole 323H. The hollow cylindrical portion 323J is inserted into the hollow cylindrical interior of the pressing member 34. A tip part (front end part) of the hollow cylindrical portion 323J on the upstream side in the first direction DA is formed into a ring shape and functions as a pressed portion 323J1 (FIG. 14) to be pressed by the pressing member 34.

As shown in FIG. 14, the wall body portion 323 includes four stud receiving portions 323B, four wall engaging portions 323C and four wall surface ribs 323L. The four stud receiving portions 323B allow the respective four studs 321B described above to pass therethrough. Similarly, the four wall engaging portions 323C allow the respective four engaging pieces 321C described above to be locked (see FIG. 15). The four wall surface ribs 323L are ribs projecting from a left side surface of the wall body portion 323, and respectively extend to connect the stud receiving portions 323B and the wall engaging portions 323C. Note that the four wall surface ribs 323L include one first wall surface rib 323L1 and three second wall surface ribs 323L2. The first wall surface rib 323L1 extends upward from an upper end part of the hollow cylindrical portion 323J. The three second wall surface ribs 323L2 respectively extend radially outward from left, right and lower end parts of the hollow cylindrical portion 323J. The first wall surface rib 323L1 is formed with an insertion hole H. The insertion hole H is an opening formed to penetrate through the first wall surface rib 323L1 in the front-rear direction, and the pressing member 34 is insertable thereinto.

Further, with reference to FIG. 13, three seal pressing ribs 323F annular in the circumferential direction of the shaft 33 and projecting toward the seal member 322 are provided on the right side surface of the wall body portion 323 to surround the four stud receiving portions 323B and the four wall engaging portions 323C. The three seal pressing ribs 323F are respectively ribs similar to an outer peripheral shape of the wall body portion 323 and arranged at a distance from each other in a radial direction. The outermost seal pressing rib 323F is arranged near an outer peripheral part of the small diameter portion 323T. Further, the inner-most seal pressing rib 323F is arranged in proximity to the four stud receiving portions 323B and the four wall engaging portions 323C. These seal pressing ribs 323F have a function of coming into contact with a side surface of the seal member 322 to press the seal member 322 and restricting a base end position of a compressively deformed part of the seal member 322 in the radial direction.

With reference to FIG. 13, a plurality of outer peripheral ribs 323R are arranged at intervals in the circumferential direction on an outer peripheral part of the large diameter portion 323S. The plurality of outer peripheral ribs 323R maintain the posture of the moving wall 32 by being slightly held in contact with the inner peripheral surface 37K of the container body 37.

With reference to FIGS. 11 and 13, when the wall plate 321, the seal member 322 and the wall body portion 323 are integrated, the outer peripheral part of the seal member 322 is arranged on a radially outermost side. As a result, the outer peripheral part of the seal member 322 (outer peripheral surface 32K of the moving wall 32) is compressively deformed by the inner peripheral surface 37K of the container body 37. As a result, it is prevented that the toner in the first space 37S1 flows to a side upstream of the moving wall 32 in a moving direction (first direction DA) from a clearance between the inner peripheral surface 37K of the container body 37 and the outer peripheral surface 32K of the moving wall 32. At this time, the position of the radially base end part of the compressively deformed part is restricted by the plurality of seal pressing ribs 323F. Thus, the compressed part of the outer peripheral part of the seal member 322 is limited and a strong pressing force toward the inner peripheral surface 37K of the container body 37 can be maintained.

Further, the outer peripheral part of the large diameter portion 323S of the wall body portion 323 and the outer peripheral part of the wall plate 321 are arranged slightly radially inward of the outer peripheral part of the seal member 322. By sandwiching the surface-like (plate-like) seal member 322 by the wall plate 321 and the wall body portion 323 in this way, it is suppressed that the outer peripheral part of the seal member 322 is separated according to a movement of the moving wall 32. In other words, the occurrence of seal turn-up is prevented as compared to the case where a tape-like seal member is wound on the outer peripheral part of the moving wall 32. Further, the small diameter portion 323T is arranged radially inward of the large diameter portion 323S. As a result, when the moving wall 32 moves in the first direction DA, the outer peripheral part of the seal member 322 is allowed to enter a step part between the large diameter portion 323S and the small diameter portion 323T on the upstream side in the first direction DA. Thus, it is prevented that an excessive load is applied to the outer peripheral part of the seal member 322 to break this outer peripheral part.

With reference to FIGS. 12 and 13, when the seal member 322 is sandwiched between the wall plate 321 and the wall body portion 323, a part of the seal member 322 around the seal shaft hole 322H is squeezed, whereby a shaft seal portion is formed to be held in close contact with the outer peripheral surface of the shaft 33 entirely in the circumferential direction. The shaft seal portion is arranged on a side upstream of the internally threaded portion 34J of the pressing member 34 in the first direction DA (FIG. 11). Thus, the shaft seal portion contacts the externally threaded portion 333 of the shaft 33 earlier than the internally threaded portion 34J to clean the toner adhering to the externally threaded portion 333. Further, since being ring-shaped to surround the shaft 33, the shaft seal portion is held in close contact with the shaft 33 entirely in the circumferential direction of the shaft 33. This prevents the toner in the first space 37S1 to flow out to a side upstream of the moving wall 32 in the moving direction (first direction DA) through a bearing part of the moving wall 32.

Figure 16:
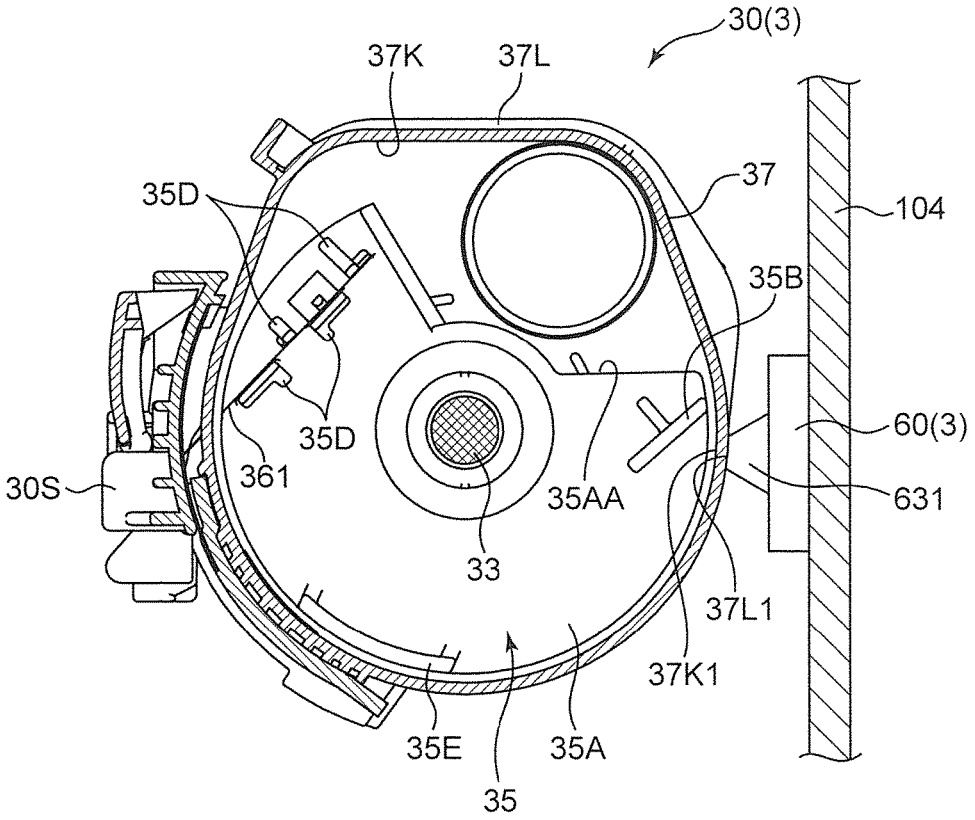
FIG. 16 is a section along line XVI-XVI of FIG. 8.
Figure 17:
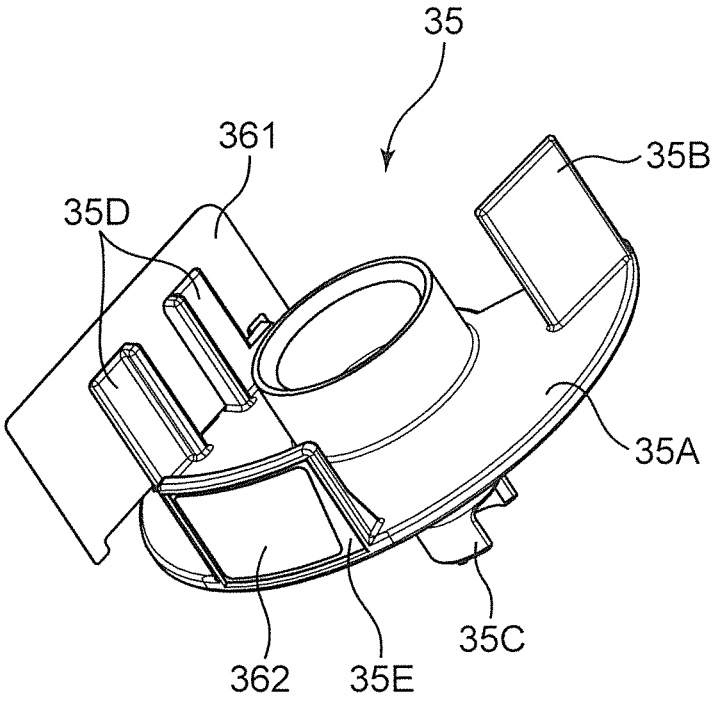
FIG. 17 is a perspective view of a rotary body of the developer storage container.

Next, the rotary body 35 provided in the toner container 30 is described with reference to FIGS. 16 and 17 in addition to FIGS. 10 and 11. FIG. 16 is a sectional view along section line XVI-XVI of the toner container 30 of FIG. 8. FIG. 17 is a perspective view of the rotary body 35.

The rotary body 35 is arranged near the toner discharge port 377 in the first space 37S of the container body 37 and rotates about the shaft 33 extending in the first direction DA. Specifically, the rotary body 35 is arranged along the right wall 375 above the toner discharge port 377. In this embodiment, the rotary body 35 includes a plate portion 35A, a stirring blade portion 35B, a rotary body bearing portion 35C, a first supporting projecting piece 35D and a second supporting projecting piece 35E.

The plate portion 35A is a plate-like member formed with a cut portion 35AA by arcuately cutting a part of an outer peripheral end of a disc-like member, and rotatable about the shaft 33. The plate portion 35A is inserted on the first shaft end part 331 of the shaft 33 and retained on the shaft 33 by a pair of retaining members 35F.

The stirring blade portion 35B is a blade part extending from the plate portion 35A toward an upstream side in the first direction DA, i.e. toward the moving wall 32. The stirring blade portion 35B turns about the shaft 33 above the toner discharge port 377 according to the rotation of the plate portion 35A. In this way, the stirring blade portion 35B stirs the toner in the first space 37S1.

The stirring bearing portion 35C is a hollow cylindrical part extending rightward from the plate portion 35A and houses the shaft 33 inside. Further, a tip part of the stirring bearing portion 35C is engageable with an end 381A of the rotary body drive gear 381.

The first supporting projecting piece 35D is a projecting piece extending from the plate portion 35A toward the upstream side in the first direction DA, i.e. toward the moving wall 32. The first supporting projecting piece 35D is arranged at a distance from the stirring blade portion 35B in the circumferential direction on the plate portion 35A. A cleaning member 361 is mounted on this first supporting projecting piece 35D.

The cleaning member 361 is a flexible film member extending along a rotating direction (circumferential direction) of the rotary body 35. The cleaning member 361 is made of an electrically insulating material (e.g. polyethylene terephthalate, PET). The cleaning member 361 turns about the shaft 33 above the toner discharge port 377 according to the rotation of the rotary body 35 (plate portion 35A). When the rotary body 35 rotates, the cleaning member 361 scrapes off the toner adhering to a specific area 37K1 (see FIG. 9) of the inner peripheral surface 37K while sliding in contact with the inner peripheral surface 37K of the container body 37. Note that the specific area 37K1 to be cleaned by the cleaning member 361 on the inner peripheral surface 37K of the container body 37 is an area facing a container sensor 61 (detection sensor) to be described later. Further, the cleaning member 361 also has a function of feeding the toner in the first space 37S1 through the toner discharge port 377.

The second supporting projecting piece 35E is a projecting piece extending from the plate portion 35A toward the upstream side in the first direction DA, i.e. toward the moving wall 32. The second supporting projecting piece 35E is arranged at a distance from the stirring blade portion 35B and the first supporting projecting piece 35D in the circumferential direction on the plate portion 35A. The second supporting projecting piece 35E turns about the shaft 33 above the toner discharge port 377 and the specific area 37K1 according to the rotation of the plate portion 35A. An attachment detecting member 362 is mounted on an outer surface of this second supporting projecting piece 35E. The attachment detecting member 362 is made of a material enabling detection by the later-described container sensor 61 (e.g. copper tape member). Although described in detail later, the attachment detecting member 362 is used to detect the attachment of the toner container 30 to the developing device 20.

The rotary body drive gear 381 constitutes a part of the rotary body driver 42 (FIG. 6) of the container driving unit 40. The rotary body drive gear 381 transmits a drive force of the rotary body drive motor M2 (FIG. 6) to the rotary body 35. The rotary body drive gear 381 is coupled to the rotary body drive motor M2 via the first and second transmission gears 211, 212 of the developing device 20. In this embodiment, the rotary body drive gear 381 is rotationally driven in synchronization with the developing roller 21, the first stirring screw 23 and the second stirring screw 24 of the developing device 20. The rotary body drive gear 381 is coupled to the tip of the stirring bearing portion 35C of the rotary body 35 passed through the body bearing portion 37J. As a result, the rotary body drive gear 381 and the rotary body 35 integrally rotate.

As shown in FIG. 16, a sensor unit 60 is arranged to face the inner surface specific area 37K1 of the inner peripheral surface 37K of the container body 37 from the outside of the container body 37. In other words, the sensor unit 60 is arranged to face an outer surface specific area 37L (see FIGS. 1, 9, 10 and 16) corresponding to the inner surface specific area 37K1 on the outer peripheral surface 37L of the container body 37. In the container body 37, the inner surface specific area 37K1 and an outer specific area 37L1 are set to be above the toner discharge port 377 in the circumferential direction and substantially at the same height position as the axis of the shaft 33 in the vertical direction.

Figure 18:
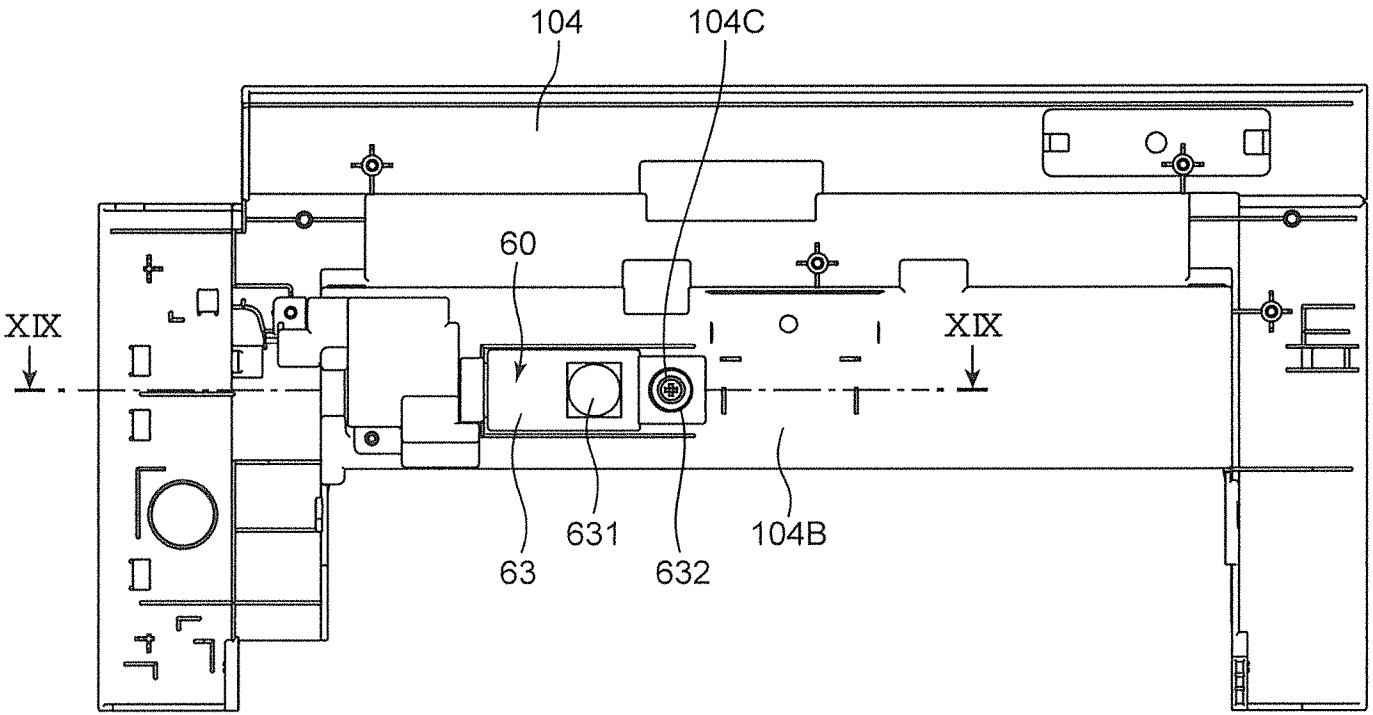
FIG. 18 is a plan view showing a sensor unit mounted on a cover member in a housing of the image forming apparatus.
Figure 19:
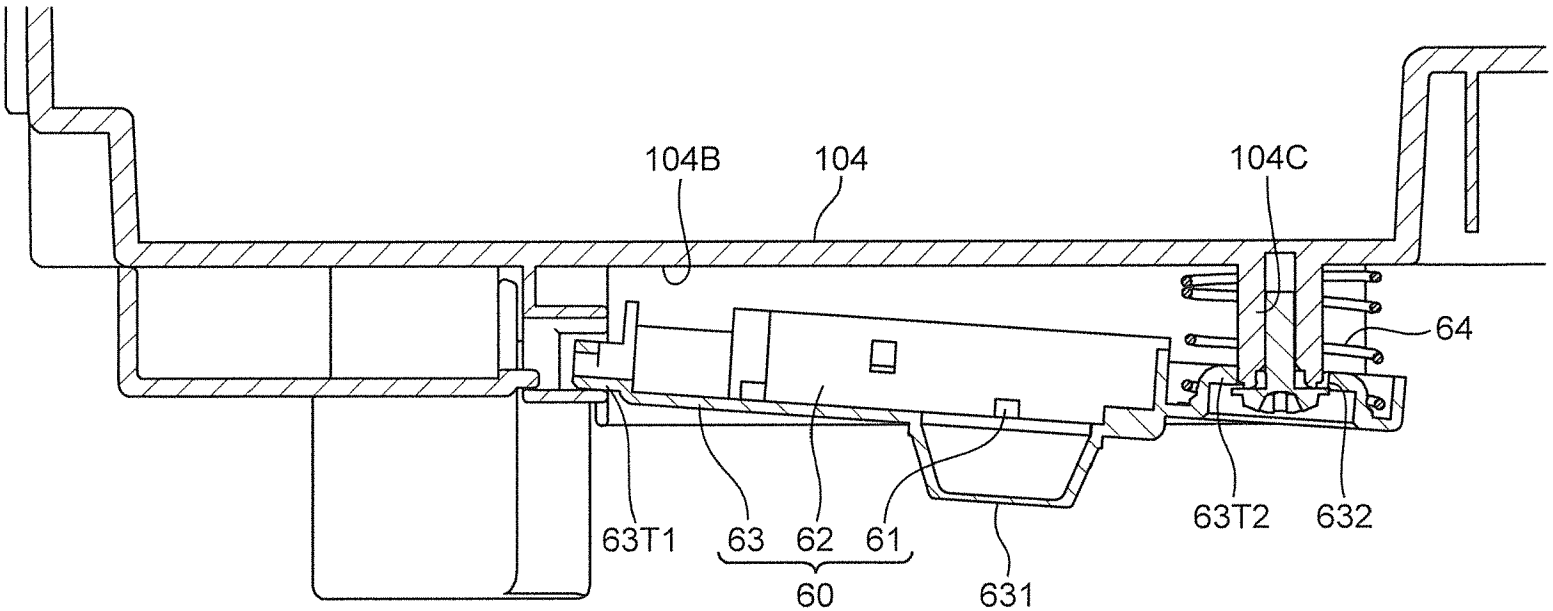
FIG. 19 is a section along line XIX-XIX of FIG. 18.

The sensor unit 60 is described with reference to FIGS. 18 and 19 in addition to FIGS. 1 to 3. FIG. 18 is a plan view showing the sensor unit 60. FIG. 19 is a section along section line XIX-XIX of the sensor unit 60 of FIG. 18. The sensor unit 60 constitutes a part of the toner replenishing device 3 and is mounted on an inner surface 104B of the front cover 104 in the housing 101. As shown in FIG. 19, the sensor unit 60 includes the container sensor 61, a circuit board 62 carrying the container sensor 61, a holder 63 and a biasing member 64.

The container sensor 61 is a detection sensor for detecting the toner stored in the first space 37S1 of the container body 37 and outputting a signal corresponding to that detection. In this embodiment, the container sensor 61 is a magnetic permeability sensor (magnetic sensor). The container sensor 61 formed of a magnetic permeability sensor detects a magnetic field, which changes in the same cycle as the rotation cycle of the rotary body 35, in the first space 37S1 of the container body 37 and converts the detected magnetic field into an electrical signal. The container sensor 61 has a property of increasing the detected magnetic field when detecting the toner (magnetic toner) stored in the first space 37S1 of the container body 37. The container sensor 61 outputs a High signal (hereinafter, referred to as an "H signal") representing the detection of the toner when detecting a magnetic field of an intensity having a predetermined value or larger. On the other hand, the container sensor 61 outputs a Low signal (hereinafter, referred to as an "L signal") when not operating or when the intensity of the magnetic field in the first space 37S1 is below the predetermined value.

The holder 63 has a predetermined length in the lateral direction and holds the circuit board 62 carrying the container sensor 61. The holder 63 includes a sensor covering portion 631 for covering the container sensor 61 and is supported on the inner surface 104B of the front cover 104 to expose the sensor covering portion 631. In this embodiment, the sensor covering portion 631 is arranged in a substantially lateral center of the holder 63 and one end part 63T1 (right end part) of the holder 63 in the lateral direction is supported on the inner surface 104B of the front cover 104. Further, another end part 63T2 (left end part) of the holder 63 in the lateral direction is formed with an insertion opening 632 into which a projection 104C of the front cover 104 is inserted. On the front cover 104, the projection 104C projects from the inner surface 104B.

The biasing member 64 is connected between the front cover 104 and the holder 63 and biases the holder 63 holding the circuit board 62 carrying the container sensor 61 in a direction away from the inner surface 104B of the front cover 104. In this embodiment, the biasing member 64 is a coil spring member inserted on the projection 104C of the front cover 104, one end part thereof is connected to the front cover 104 and the other end part is connected to the holder 63.

The sensor unit 60 configured as described above is displaced between a detection position where the toner can be detected by the container sensor 61 and a detection disable position where the toner cannot be detected by the container sensor 61 as the posture of the front cover 104 changes due to rotation. The sensor unit 60 is arranged at the detection position where the container sensor 61 faces the outer surface specific area 37L1 of the container body 37 via the sensor covering portion 631 when the front cover 104 is in the closing posture.

Further, when the sensor unit 60 is arranged at the detection position by the front cover 104 being set in the closing posture, the sensor covering portion 631 of the holder 63 comes into contact with the outer surface specific area 37L1 of the container body 37. In this way, the container sensor 61 faces the outer surface specific area 37L1 of the container body 37 via the sensor covering portion 631, thereby enabling the container sensor 61 to detect the toner in the first space 37S1 of the container body 37. At this time, the sensor covering portion 631 is elastically pressed by a biasing force of the biasing member 64 to the holder 63 to come into contact with the outer surface specific area 37L1 of the container body 37. In this way, the sensor covering portion 631 comes into close contact with the outer surface specific area 37L1 of the container body 37. Thus, the container sensor 61 can suitably detect the toner in the first space 37S1 of the container body 37.

On the other hand, when the front cover 104 is in the opening posture, the sensor unit 60 is arranged at the detection disable position where the container sensor 61 is distant from the outer surface specified area 37L1 of the container body 37.

In the toner replenishing device 3 of this embodiment, a moving operation of the moving wall 32 of the toner container 30 is controlled and toner replenishment to the developing device 20 is controlled based on output signals of the container sensor 61. A toner replenishment control for the developing device 20 in the toner replenishing device 3 is described in detail later.

Further, the sensor unit 60 is arranged at the detection position according to the posture change of the front cover 104 and an H signal is output from the container sensor 61, whereby it can be detected that the front cover 104 is in the closing posture. On the other hand, if the sensor unit 60 is arranged at the detection disable position according to the posture change of the front cover 104 and no H signal is output from the container sensor 61, it is assumed that the front cover 104 is in the opening posture.

In the image forming apparatus 1 configured as described above, a toner detection result by the container sensor 61 of the sensor unit 60 is utilized to control a movement control of the moving wall 32 and detect the posture of the front cover 104. Thus, a dedicated sensor for detecting the opening/closing of the front cover 104 needs not be provided, and the number of components for sensors can be maximally reduced. Therefore, in the image forming apparatus 1, the configuration of a control system for controls based on output signal of the sensors can be simplified.

Figure 21:
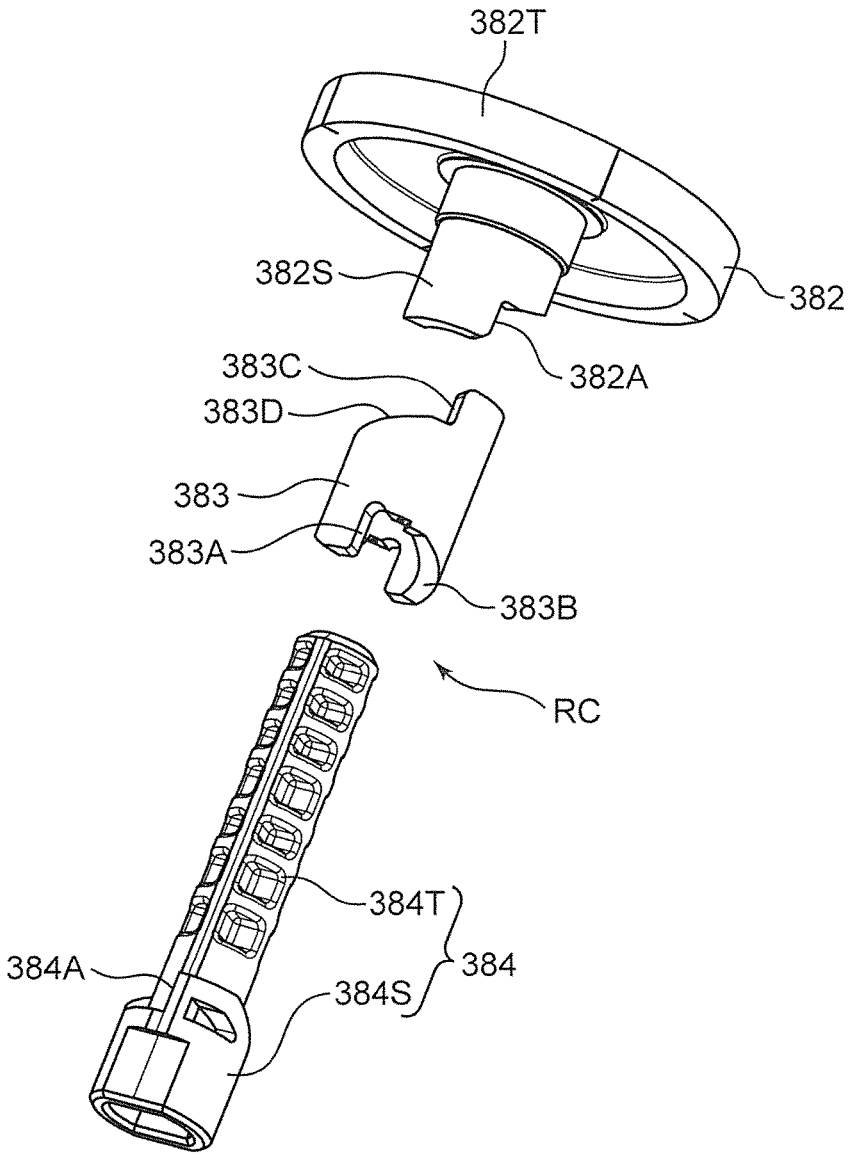
FIG. 21 is an exploded perspective view of the ratchet mechanism.
Figure 22:
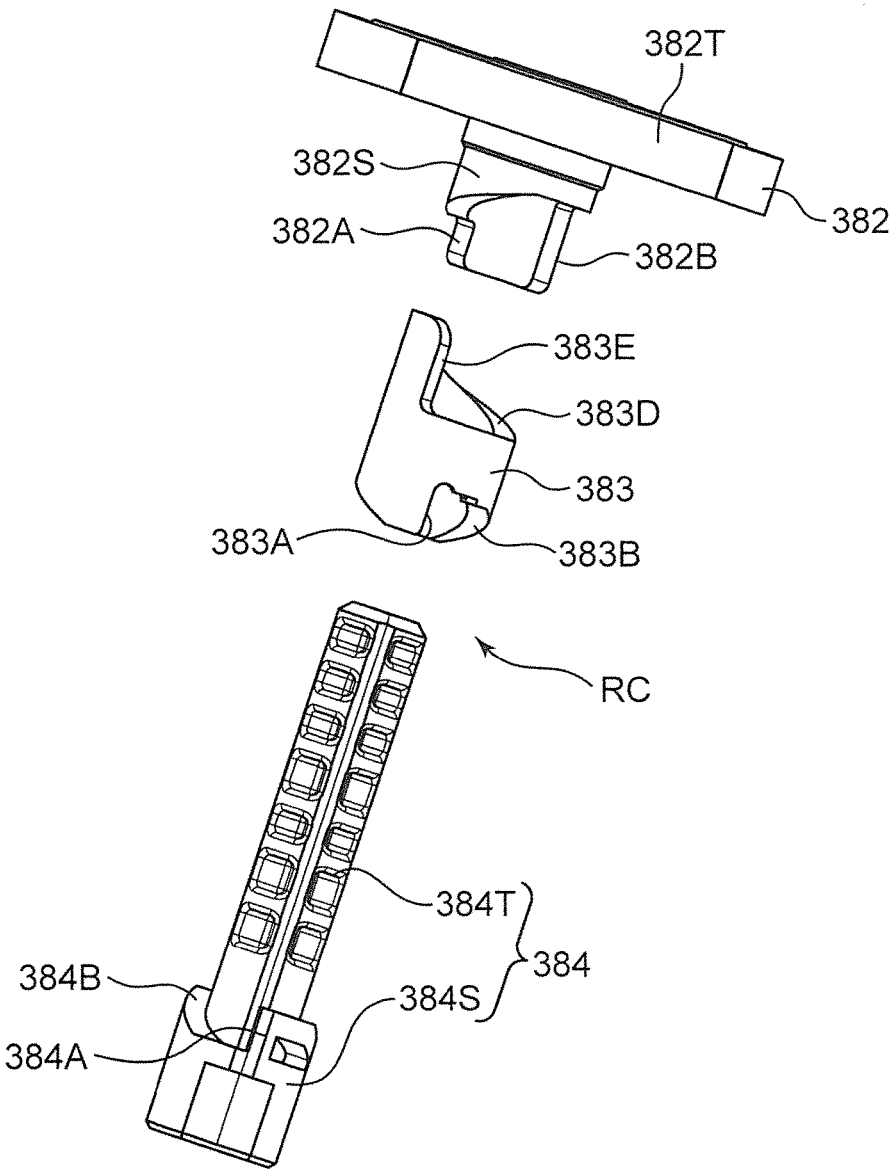
FIG. 22 is an exploded perspective view of the ratchet mechanism.
Figure 23:
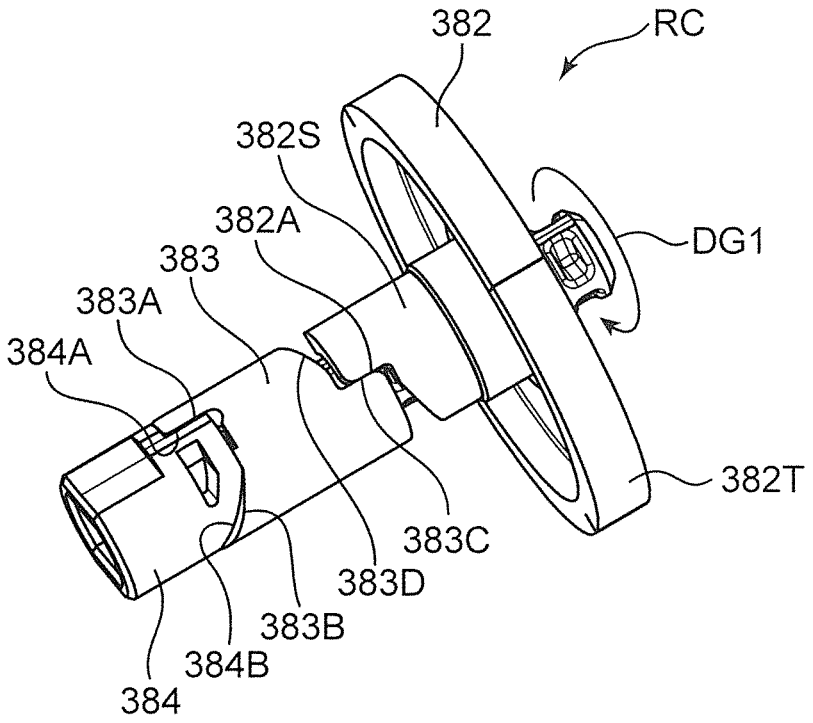
FIG. 23 is a perspective view of the ratchet mechanism.
Figure 24:
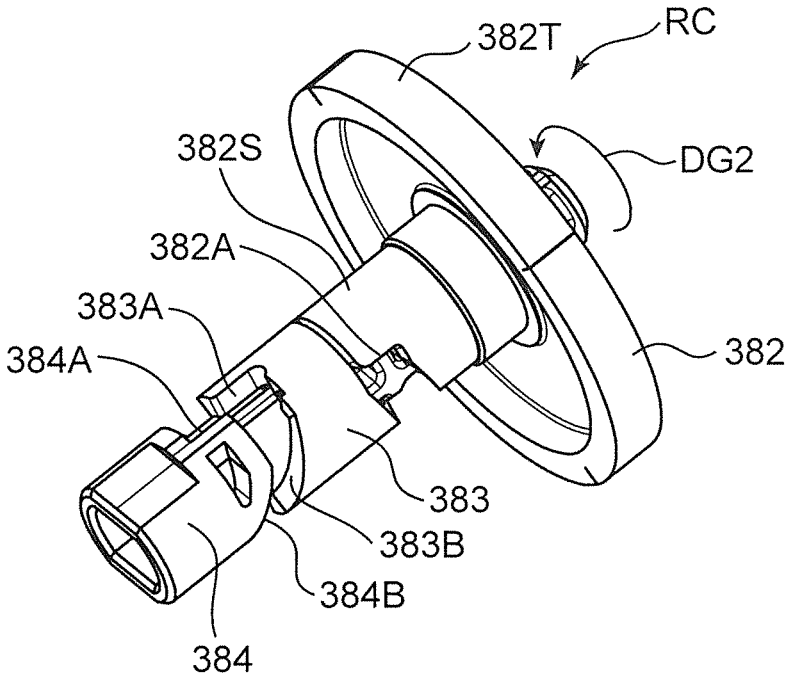
FIG. 24 is a perspective view of the ratchet mechanism.

Next, the ratchet mechanism RC provided in the toner container 30 is described with reference to FIGS. 20 to 24 in addition to FIGS. 10 and 11. FIG. 20 is an exploded perspective view of the toner container 30. FIGS. 21 and 22 are exploded perspective views of the ratchet mechanism RC of the toner container 30. FIGS. 23 and 24 are perspective views of the ratchet mechanism RC of the toner container 30. In this embodiment, the shaft drive gear 382, the ratchet gear 383 and the ratchet shaft 384 constitute the ratchet mechanisms RC for transmitting a rotational drive force to the shaft 33. The ratchet mechanism RC constitutes a part of the moving wall driver 41 (FIG. 6) of the container driving unit 40.

The shaft drive gear 382 constitutes a part of the moving wall driver 41. The shaft drive gear 382 is coupled to the first shaft end part 331 of the shaft 33 and transmits a drive force of the moving wall drive motor M1 (FIG. 6) to the shaft 33. The shaft drive gear 382 is arranged coaxially with the shaft 33. The shaft drive gear 382 is coupled to the moving wall drive motor M1 via the third transmission gear 213. The shaft drive gear 382 can rotate the shaft 33 by being rotated by a drive force generated by the moving wall drive motor M1. As shown in FIG. 11, a right end part of the shaft 33 is arranged through the rotary body 35. Then, the shaft drive gear 382 is coupled (fixed) to the first shaft end part 331 of the shaft 33 via the ratchet gear 383 and the ratchet shaft 384.

With reference to FIGS. 21 and 22, the shaft drive gear 382 includes a hollow cylindrical portion 382S and a disc-like gear portion 382T connected to the hollow cylindrical portion 382S. Unillustrated gear teeth are formed on an outer peripheral part of the gear portion 382T. A shaft portion 384T of the ratchet shaft 384 is insertable into the hollow cylindrical portion 382S. The hollow cylindrical portion 382S includes an engaging portion 382A extending in an axial direction of the ratchet shaft 384 (axial direction of the shaft 33).

The ratchet gear 383 has a hollow cylindrical shape and the shaft portion 384T of the ratchet shaft 384 is insertable thereinto. The ratchet gear 383 is arranged between the shaft 33 and the shaft drive gear 382 in the axial direction and rotatable about the axis of the shaft 33. The ratchet gear 383 includes an engaging portion 383A extending in the axial direction of the ratchet shaft 384 and an inclined portion 383B facing the engaging portion 383A in a circumferential direction. Further, the ratchet gear 383 includes an engaging portion 383C arranged on a side opposite to the engaging portion 383A and the inclined portion 383B in the axial direction and extending in the axial direction of the ratchet shaft 384 and an inclined portion 383D facing the engaging portion 383C in the circumferential direction.

Further, the ratchet shaft 384 is arranged between the shaft drive gear 382 and the shaft 33 in the axial direction and rotatable integrally with the shaft 33. The ratchet shaft 384 includes a base end part 384S and the shaft portion 384T. The base end part 384S has a substantially hollow cylindrical shape. The hollow cylindrical interior of the base end part 384S has a pair of D surface shapes. The first shaft end part 331 (FIG. 20) of the shaft 33 is inserted and engaged inside the base end part 384S. As a result, the shaft 33 and the ratchet shaft 384 are integrally rotatable. The shaft portion 384T extends in the axial direction from the base end part 384S. An outer diameter of the shaft portion 384T is smaller than that of the base end part 384S. An engaging portion 384A extending in the axial direction of the ratchet shaft 384 and an inclined portion 384B facing the engaging portion 384A in the circumferential direction are provided on an end part of the base end part 384S on the side of the shaft portion 384T.

As shown in FIGS. 23 and 24, the hollow cylindrical portion 382S of the shaft drive gear 382 is externally fitted on the ratchet shaft 384 after the ratchet gear 383 is externally fitted on the ratchet shaft 384. As a result, the engaging portion 382A is arranged to face the engaging portion 383C and the engaging portion 384A is arranged to face the engaging portion 383A in the circumferential direction about the ratchet shaft 384. If the shaft drive gear 382 is rotated in a first rotating direction DG1 (see FIG. 23), the engaging portion 382A moves along the inclined portion 383D to press the ratchet gear 383 toward the base end part 384S in the axial direction. Eventually, the engaging portion 382A comes into contact with the engaging portion 383C to press the engaging portion 383C in the first rotating direction DG1. Further, the engaging portion 383A comes into contact with the engaging portion 384A to press the engaging portion 384A in the first rotating direction DG1. As a result, the shaft 33 coupled to the ratchet shaft 384 rotates in the first rotating direction R1 (see FIG. 11). Specifically, the pressing member 34 and the moving wall 32 move in the first direction DA. Note that the first rotating direction DG1 in the shaft drive gear 382 and the first rotating direction R1 in the shaft 33 are the same direction.

On the other hand, if the shaft drive gear 382 is rotated in a second rotating direction DG2 (see FIG. 24) opposite to the first rotating direction DG1, the engaging portion 382A is separated from the engaging portion 383C in the circumferential direction. Further, the engaging portion 382B of the shaft drive gear 382 presses an engaging portion 383E of the ratchet gear 383 in the second rotating direction DG2. As a result, the ratchet gear 383 rotates in the second rotating direction DG2. At this time, since the ratchet shaft 384 does not press the ratchet gear 383 toward the shaft portion 384T, the ratchet gear 383 and the ratchet shaft 384 (engaging portion 384A) are disengaged and the ratchet gear 383 idly rotates in the second rotating direction DG2.

As a result, a rotational force in the second rotating direction DG2 is not transmitted to the ratchet shaft 384, with the result that the shaft 33 does not rotate in a second rotating direction R2 (see FIG. 11). Specifically, as the shaft drive gear 382 rotates in the second rotating direction DG2, movements of the pressing member 34 and the moving wall 32 in the first direction DA are suppressed. Further, since the shaft 33 does not rotate in the second rotating direction R2, the pressing member 34 does not relatively move to the upstream side in the first direction DA with respect to the moving wall 32. Thus, even if a user erroneously rotates the shaft drive gear 382 in the second rotating direction R2 when detaching the toner container 30 from the developing device 20, a movement of the moving wall 32 to the upstream side in the first direction DA is prevented.

As just described, in this embodiment, the ratchet mechanism RC composed of the shaft drive gear 382, the ratchet gear 383 and the ratchet shaft 384 transmits a rotational drive force of the shaft drive gear 382 in the first rotating direction DG1 to the shaft 33 and restricts the transmission of a rotational drive force of the shaft drive gear 382 in the second rotating direction DG2 to the shaft 33.

<Control System of Image Forming Apparatus>

Figure 25:
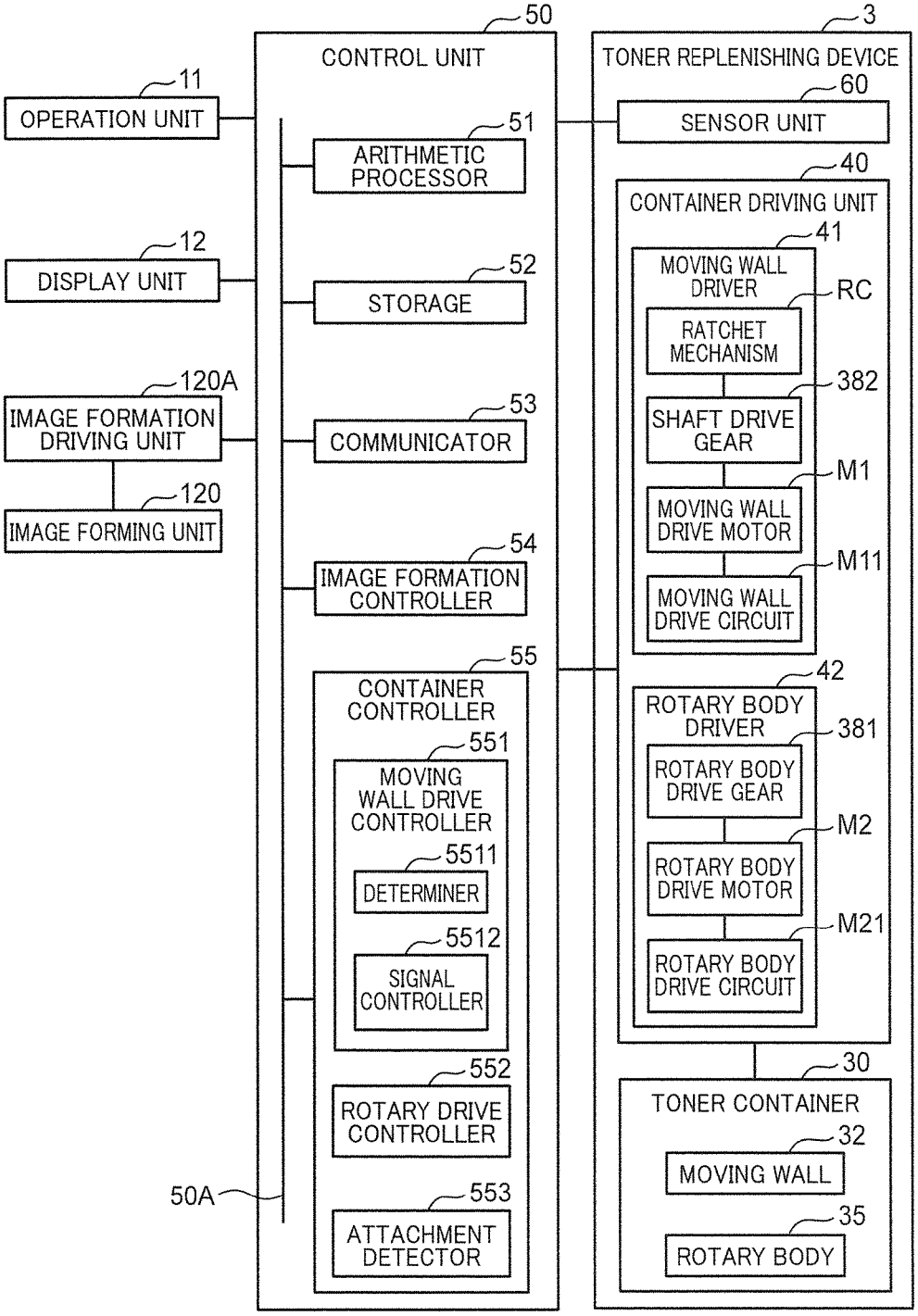
FIG. 25 is a block diagram showing the configuration of a control system of the image forming apparatus, FIGS. 26 (1) and 26(2) are charts showing output signals of a detection sensor of the sensor unit, and FIG. 27 are charts showing a developer replenishment control operation and a developer empty control operation in the developer replenishing device.

Next, a control system of the image forming apparatus 1 is described with reference to a block diagram of FIG. 25. The image forming apparatus 1 includes an operation unit 11, a display unit 12, an image formation driving unit 120A and a control unit 50 in addition to the toner replenishing device 3 including the aforementioned sensor unit 60, toner container 30 and container driving unit 40 and the image forming unit 120.

The operation unit 11 is an interface data-communicably connected to the control unit 50 and configured to receive a user operation and information from external equipment. For example, information such as the number of printed sheets S, the size of the sheets S and the type of the sheets S, print start command information representing a print start and image forming process information relating to conditions of an image forming process including image data are input to the operation unit 11. The display unit 12 is data-communicably connected to the control unit 50 and displays message information relating to an image forming operation of the image forming apparatus 1 to be notified to the user.

The image formation driving unit 120A is a driving unit for operating the photoconductive drum 121, the charger 122, the exposure device 123, the transfer roller 126 and the cleaning device 127 of the image forming unit 120 other than the developing device 20 and the toner replenishing device 3. The toner container 30 of the toner replenishing device 3 is driven by the container driving unit 40. The developing roller 21, the first stirring screw 23 and the second stirring screw 24 of the developing device 20 are driven by the rotary body driver 42 of the container driving unit 40 to be synchronized with the drive of the rotary body 35 of the toner container 30.

The container driving unit 40 of the toner replenishing device 3 includes the moving wall driver 41 and the rotary body driver 42. The moving wall driver 41 includes the moving wall drive motor M1 and a moving wall drive circuit M11 in addition to the aforementioned shaft drive gear 382 and the ratchet mechanism RC. The moving wall drive motor M1 is a drive motor for generating a drive force for rotating the shaft 33 of the toner container 30. The drive force generated by the moving wall drive motor M1 is transmitted to the shaft 33 via the third transmission gear 213, the shaft drive gear 382 and the ratchet mechanism RC. In this way, the shaft 33 rotates in the first rotating direction R1. The moving wall 32 moves in the first direction DA along the shaft 33 by the rotation of the shaft 33 in the first rotating direction R1. The moving wall drive circuit M11 is a drive circuit for controlling the drive of the moving wall drive motor M1, and data-communicably connected to the control unit 50.

The rotary body driver 42 includes the rotary body drive motor M2 and a rotary body drive circuit M21 in addition to the aforementioned rotary body drive gear 381. The rotary body drive motor M2 is a drive motor for generating a drive force for rotating the rotary body 35 of the toner container 30. The drive force generated by the rotary body drive motor M2 is transmitted to the rotary body 35 via the first transmission gear 211, the second transmission gear 212 and the rotary body drive gear 381. In this way, the rotary body 35 rotates about the shaft 33. The rotary body drive circuit M21 is a drive circuit for controlling the drive of the rotary body drive motor M2 and data-communicably connected to the control unit 50. Note that the drive force generated by the rotary body drive motor M2 is also transmitted to the developing roller 21, the first stirring screw 23 and the second stirring screw 24 of the developing device 20 via the first transmission gear 211. In this way, the developing roller 21, the first stirring screw 23 and the second stirring screw 24 of the developing device 20 rotate.

The control unit 50 includes an arithmetic processor 51 for integrally controlling the operation of the image forming apparatus 1, a storage 52 storing an image forming program and the like, a communicator 53, an image formation controller 54 and a container controller 55.

The arithmetic processor 51 is a computer composed of a CPU and memories and connected to the storage 52, the communicator 53, the image formation controller 54 and the container controller 55 via a bus 50A. The arithmetic processor 51 performs an image forming process based on the image forming program stored in the storage 52 and performs various arithmetic processings associated with the image forming process.

A reference threshold value for an output number of H signals output from the container sensor 61 used when a moving wall drive controller 551 of the container controller 55 to be described later executes a moving control of the moving wall 32 is stored in the storage 52 besides the image forming program.

The communicator 53 is an interface for data communication with the operation unit 11, the display unit 12 and the container sensor 61 of the sensor unit 60.

The image formation controller 54 is data-communicably connected to the image formation driving unit 120A and transmits a control signal for a control of the image forming operation of the image forming unit 120 to the image formation driving unit 120A. When the communicator 53 receives image forming process information input to the operation unit 11, the image formation controller 54 transmits a control signal corresponding to that image forming process information to the image formation driving unit 120A. The image formation driving unit 120A controls the image forming operation of the image forming unit 120 in accordance with the control signal when receiving the control signal transmitted from the image formation controller 54.

The container controller 55 constitutes a part of the toner replenishing device 3. The container controller 55 includes the moving wall drive controller 551, a rotary drive controller 552 and an attachment detector 553.

The rotary drive controller 552 is data-communicably connected to the rotary body drive circuit M21 and transmits a control signal for a drive control of the rotary body drive motor M2 to the rotary body drive circuit M21. When the communicator 53 receives image forming process information input to the operation unit 11, the rotary drive controller 552 transmits a control signal corresponding to that image forming process information to the rotary body drive circuit M21. The rotary body drive circuit M21 controls the drive of the rotary body drive motor M2 in accordance with the control signal when receiving the control signal transmitted from the rotary drive controller 552.

Figure 26:
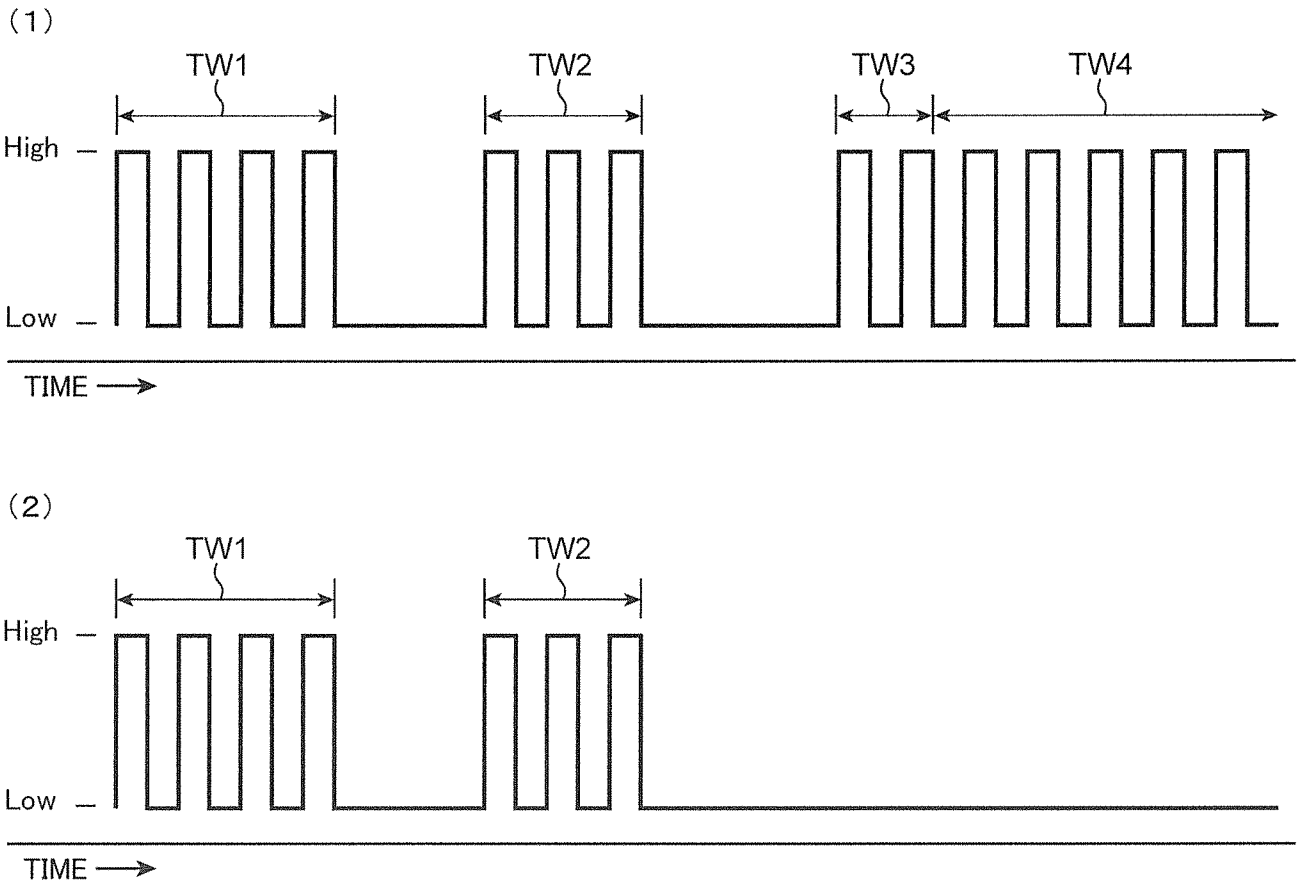

Here, when the rotary body 35 of the toner container 30 rotates by being driven by the rotary body drive motor M2, an output signal output from the container sensor 61 of the sensor unit 60 is received by the communicator 53. This output signal of the container sensor 61 is described with reference to FIGS. 26(1) and 26(2). FIGS. 26(1) and 26(2) schematically show output signals output from the container sensor 61 when one turn of the rotary body 35 is one cycle. FIG. 26(1) shows the output signals output from the container sensor 61 when the toner is present above the inner surface specific area 37K1 on the inner peripheral surface 37K of the container body 37. That is, FIG. 26(1) shows output signals of the container sensor 61 when a draft surface of the toner stored in the first space 37S1 of the container body 37 is located above the inner surface specific area 37K1. On the other hand, FIG. 26(2) shows output signals output from the container sensor 61 when the draft surface of the toner stored in the first space 3751 of the container body 37 is located below the inner surface specific area 37K1 or when the toner is empty (used up) in the first space 37S1.

It is assumed that the sensor unit 60 is arranged at the detection position and the sensor covering portion 631 of the holder 63 is in contact with the outer surface specific area 37L1 of the container body 37 by setting the front cover 104 in the closing posture. In this state, the container sensor 61 outputs H signals (High signals) or L signals (Low signals) as output signals at a predetermined time interval (e.g. 48 msec) during one cycle, which is one turn of the rotary body 35 according to a change of a magnetic field in the first space 37S1 of the container sensor 37.

With reference to FIG. 26(1), if the draft surface of the toner stored in the first space 37S1 of the container body 37 is located above the inner surface specific area 37K1, the container sensor 61 outputs a plurality of H signals in a time period TW1 during which the cleaning member 361 passes through the inner surface specific area 37K1 on the inner peripheral surface 37K of the container body 37 during the rotation of the rotary body 35. The toner is adhering to the cleaning member 361. Thus, the container sensor 61 outputs the H signals by detecting a magnetic field of an intensity having a predetermined value or larger due to the toner adhering to the cleaning member 361.

In a time period TW2 during which the second supporting projecting piece 35E passes through the inner surface specific area 37K1 during the rotation of the rotary body 35, the container sensor 61 outputs a plurality of H signals. The attachment detecting member 362 is mounted on the second supporting projecting piece 35E. Thus, the container sensor 61 outputs the H signals by detecting a magnetic field of an intensity having the predetermined value or larger due to the attachment detecting member 362.

In a time period TW3 during which the stirring blade portion 35B passes through the inner surface specific area 37K1 during the rotation of the rotary body 35, the container sensor 61 outputs a plurality of H signals. If the draft surface of the toner stored in the first space 37S1 is located above the inner surface specific area 37K1, the toner is present around the stirring blade portion 35B. Thus, the container sensor 61 outputs the H signals by detecting a magnetic field of an intensity having the predetermined value or larger due to the toner present around the stirring blade portion 35B.

In a time period TW4 during which the cut portion 35AA of the plate portion 35A passes through the inner surface specific area 37K1 during the rotation of the rotary body 35, the container sensor 61 outputs a plurality of H signals. If the draft surface of the toner stored in the first space 37S1 is located above the inner surface specific area 37K1, the toner is present around the cut portion 35AA of the plate portion 35A. Thus, the container sensor 61 outputs the H signals by detecting a magnetic field of an intensity having the predetermined value or larger due to the toner present around the cut portion 35AA.

On the other hand, with reference to FIG. 26(2), if the draft surface of the toner stored in the first space 37S1 is located below the inner surface specific area 37K1 or the toner is empty in the first space 37S1, the container sensor 61 outputs a plurality of H signals in the time period TW1 during which the cleaning member 361 passes through the inner surface specific area 37K1 during the rotation of the rotary body 35. The container sensor 61 outputs the H signals regardless of the draft surface of the toner located below the inner surface specific area 37K1 because the container sensor 61 detects the magnetic field of the intensity having the predetermined value or larger due to the toner adhering to the cleaning member 361.

In the time period TW2 during which the second supporting projecting piece 35E passes through the inner surface specific area 37K1 during the rotation of the rotary body 35, the container sensor 61 outputs the plurality of H signals. The container sensor 61 outputs the H signals regardless of the draft surface of the toner located below the inner surface specific area 37K1 because the container sensor 61 detects the magnetic field of the intensity having the predetermined value or larger due to the attachment detecting member 362 mounted on the second supporting projecting piece 35E. That is, by detecting the attachment detecting member 362 of the container sensor 61 regardless of the position of the draft surface of the toner stored in the first space 37S1 with respect to the inner surface specific area 37K1, the H signals are output from the container sensor 61.

In the time period during which the stirring blade portion 35B passes through the inner surface specific area 37K1 during the rotation of the rotary body 35, the container sensor 61 outputs L signals. If the draft surface of the toner stored in the first space 37S1 is located below the inner surface specific area 37K1, there is no toner around the stirring blade portion 35B. Thus, the container sensor 61 outputs the L signals because the intensity of the magnetic field in the first space 37S1 is below the predetermined value.

In the time period during which the cut portion 35AA of the plate portion 35A passes through the inner surface specific area 37K1 during the rotation of the rotary body 35, the container sensor 61 outputs L signals. If the draft surface of the toner stored in the first space 37S1 is located below the inner surface specific area 37K1, there is no toner around the cut portion 35AA of the plate portion 35A. Thus, the container sensor 61 outputs the L signals because the intensity of the magnetic field in the first space 37S1 is below the predetermined value.

The attachment detector 553 of the container controller 55 detects the attachment of the toner container 30 to the developing device 20 based on the output signals output from the container sensor 61. Specifically, the attachment detector 553 detects the attachment of the toner container 30 to the developing device 20 based on the H signals output from the container sensor 61 in the time period TW2 during which the second supporting projecting piece 35E mounted with the attachment detecting member 362 passes through the inner surface specific area 37K1 during the rotation of the rotary body 35. As described above, the container sensor 61 detects the attachment detecting member 362 regardless of the position of the draft surface of the toner stored in the first space 37S1 with respect to the inner surface specific area 37K1, whereby the H signals are output from the container sensor 61. Thus, the attachment detector 553 can detect the attachment of the toner container 30 to the developing device 20 if H signals due to the attachment detecting member 362 are output from the container sensor 61 during one turn of the rotary body 35.

Further, the toner container 30 is attached to the developing device 20. Thus, if the attachment of the toner container 30 to the developing device 20 is detected by the attachment detector 553, it is also detected that the developing device 20 is disposed in the internal space 107 of the housing 101. That is, the attachment of the toner container 30 to the developing device 20 can be detected and the disposition of the developing device 20 in the internal space 107 of the housing 101 can be detected based on the output signals output from the container sensor 61 of the sensor unit 60. Thus, a dedicated sensor for detecting the attachment of the toner container 30 to the developing device 20 and a dedicated sensor for detecting the disposition of the developing device 20 need not be provided, and the number of components for sensors can be more reduced. Therefore, in the image forming apparatus 1, the configuration of the control system for the controls based on output signals of the sensors can be more simplified.

Note that, when the toner container 30 is not attached to the developing device 20, H signals due to the attachment detecting member 362 are not output from the container sensor 61 even if the rotary body drive motor M2 is driven. In such a case, the attachment detector 553 transmits message information indicating that the toner container 30 is not attached to the developing device 20 (container non-attachment message information) to the display unit 12 via the communicator 53. In this way, the container non-attachment message information is displayed on the display unit 12. A user can confirm that the toner container 30 is not attached to the developing device 20 by seeing the container non-attachment message information displayed on the display unit 12.

The moving wall drive controller 551 of the container controller 55 controls a movement of the moving wall 32 in the storage space 37H of the container body 37 by controlling the drive of the moving wall drive motor M1 via the moving wall drive circuit M11. The moving wall drive controller 551 includes a determiner 5511 and a signal controller 5512.

The determiner 5511 determines an output number of the H signals output from the container sensor 61 by referring to the reference threshold value stored in the storage 52. Note that the reference threshold value referred to by the determiner 5511 is set at a value equivalent to the output number of the H signals of the container sensor 61 in a state where the draft surface of the toner stored in the first space 37S1 of the container body 37 is located at the same position as a center of the inner surface specific area 37K1.

The determiner 5511 determines whether or not the output number of the H signals is below the reference threshold value in a plurality of output signals output from the container sensor 61 at a predetermined time interval in one cycle with one cycle of rotating the rotary body 35 one turn set as a predetermined detection cycle. The determiner 5511 outputs first determination information if the output number of the H signals is below the reference threshold value while outputting second determination information if the output number of the H signals is equal to or above the reference threshold value. If the determiner 5511 outputs the first determination information, the draft surface of the toner stored in the first space 37S is located below the inner surface specific area 37K1. On the other hand, if the determiner 5511 outputs the second determination information, the draft surface of the toner stored in the first space 37S is located above the inner surface specific area 37K1.

The signal controller 5512 is data-communicably connected to the moving wall drive circuit M11. The signal controller 5512 transmits a control signal for a drive control of the moving wall drive motor M1 to the moving wall drive circuit M11 based on the determination information output from the determiner 5511. The signal controller 5512 transmits a drive permission signal, which is a control signal permitting the drive of the moving wall drive motor M1 during a reference drive time, to the moving wall drive circuit M11 when the first determination information is output from the determiner 5511. On the other hand, if the second determination information is output from the determiner 5511, the signal controller 5512 transmits a drive non-permission signal, which is a control signal not permitting the drive of the moving wall drive motor M1, to the moving wall drive circuit M11. Note that the reference drive time of the moving wall drive motor M1 is, for example, set at a drive time equivalent to a time of one turn of the rotary body 35.

The signal controller 5512 executes the toner replenishment control (developer replenishment control), which is a control for the replenishment of the toner from the toner container 30 to the developing device 20, by controlling a movement of the moving wall 32 of the toner container 30 based on the determination information output from the determiner 5511. Further, the signal controller 5512 executes a toner empty control (developer empty control), which is a control executed when the toner stored in the storage space 37S of the container body 37 is emptied, by controlling the movement of the moving wall 32 of the toner container 30 based on the determination information output from the determiner 5511.

Figure 27:
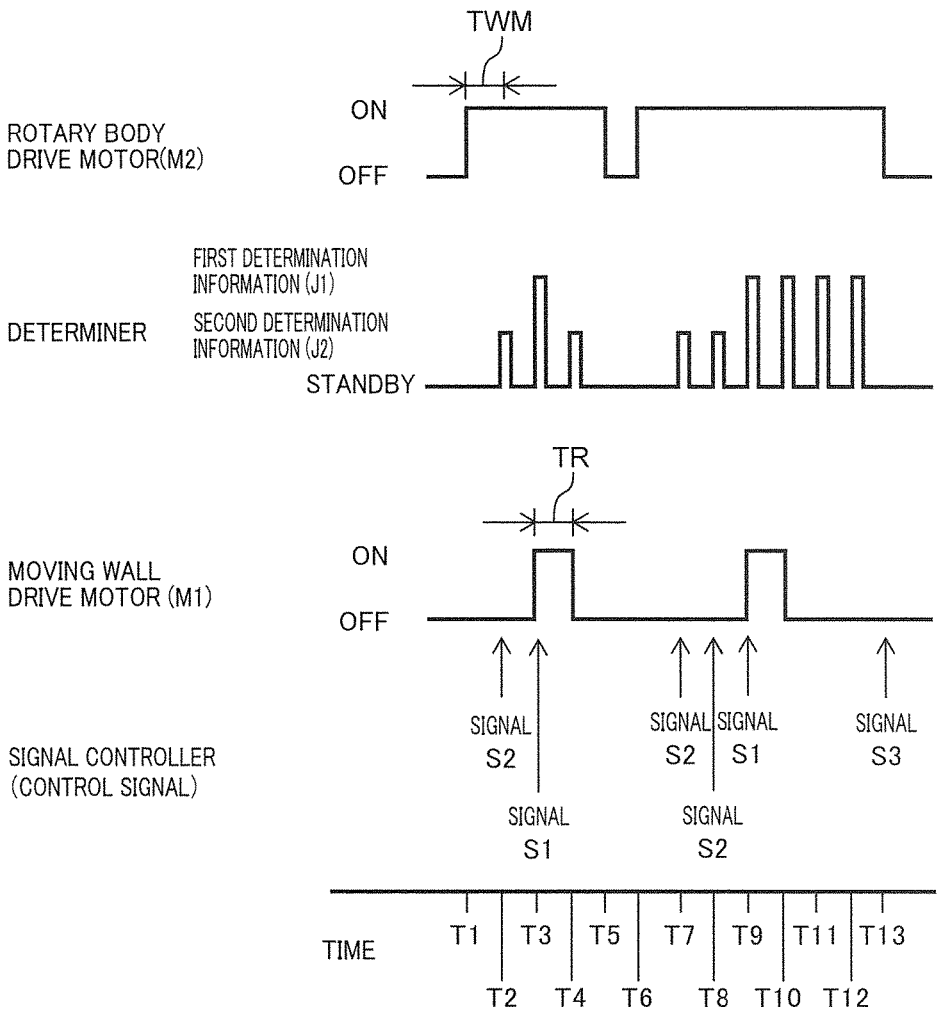

The toner replenishment control and the toner empty control executed by the moving wall drive controller 551 (signal controller 5512) are described below with reference to FIG. 27. FIG. 27 are charts showing the toner replenishment control and the toner empty control.

(Concerning Toner Replenishment Control)

The toner container 30 is mounted into the container mounting portion 109 by the user while the first guide portion 312 of the lid portion 31 and the second guide portion 391 of the cover 39 are guided by the pair of left and right guide grooves 201L and 201R of the developing device 20 (see FIGS. 6 and 7). When the toner container 30 is mounted into the container mounting portion 109, the container shutter 30S is moved to open the toner discharge port 377. As a result, the toner discharge port 377 is arranged to face the toner replenishing port 25 from above (see FIGS. 4 and 5).

As described above, the volume replenishment type toner replenishing method is adopted in this embodiment as shown in FIG. 5. Thus, if the staying portion 29 (FIG. 5) in the developing device 20 seals the toner replenishing port 25 from below, the replenishing toner particles T2 do not fall from the toner container 30.

When the communicator 53 receives the image forming process information input to the operation unit 11, the image forming operation of the image forming apparatus 1 is started. Specifically, the image formation controller 54 transmits a control signal to the image formation driving unit 120A and the rotary drive controller 552 transmits a control signal to the rotary body drive circuit M21. In this way, the drive of the image forming unit 120 and the rotary body drive motor M2 is started (time T1 of FIG. 27).

When the rotary body drive motor M2 is driven, the rotary body 35 of the toner container 30 rotates about the shaft 33. Further, when the rotary body drive motor M2 is driven, the developing roller 21 of the developing device 20 rotates to supply the toner to the photoconductive drum 121.

The determiner 5511 determines whether or not the output number of H signals output from the container sensor 61 during one cycle TWM (see FIG. 27) represented by a time period during which the rotary body 35 rotates one turn (time period from time T1 to time T2 of FIG. 27) is below the reference threshold value. If the output number of the H signals is equal to or above the reference threshold value, the determiner 5511 outputs second determination information J2 (time T2 of FIG. 27).

If the second determination information J2 is output from the determiner 5511, the signal controller 5512 transmits a drive non-permission signal S2 not permitting the drive of the moving wall drive motor M1 to the moving wall drive circuit M11 (time T2 of FIG. 27). When receiving the drive non-permission signal S2 transmitted from the signal controller 5512, the moving wall drive circuit M11 does not drive the moving wall drive motor M1. Thus, the moving wall 32 does not move.

If the drive of the rotary body drive motor M2 is continued and the toner continues to be supplied from the developing roller 21 of the developing device 20 to the photoconductive drum 121, the toner in the staying portion 29 in the developing device 20 decreases. Thus, the toner stored in the first space 37S1 of the container body 37 flows from the toner discharge port 377 into the developing device 20 via the toner replenishing port 25. At this time, the rotary body 35 is rotating by being driven by the rotary body drive motor M2. As a result, the stirring blade portion 35B provided in the rotary body 35 turns about the shaft 33 above the toner discharge port 377, wherefore the toner above the toner discharge port 377 is stably stirred. In this way, the fluidity of the toner in the first space 37S1 of the container body 37 increases and the toner stably falls through the toner discharge port 377.

If the toner falls through the toner discharge port 377 as the toner in the staying portion 29 in the developing device 20 decreases, the toner stored in the first space 37S1 decreases and the draft surface of the toner is located below the inner surface specific area 37K1 (time period from time T2 to time T3 of FIG. 27). In this case, the output number of the H signals output from the container sensor 61 becomes below the reference threshold value, and the determiner 5511 outputs first determination information J1 (time T3 of FIG. 27). As just described, the determiner 5511 determines a decreasing state of the toner stored in the first space 37S based on the output number of the H signals output from the container sensor 61 during the one cycle TMW of rotating the rotary body 35 one turn. Thus, the determiner 5511 can determine the decreasing state of the toner in the first space 37S1 with high accuracy.

If the first determination information J1 is output from the determiner 5511, the signal controller 5512 transmits a drive permission signal S1 permitting the drive of the moving wall drive motor M1 to the moving wall drive circuit M11 (time T3 of FIG. 27). When receiving the drive permission signal S1 transmitted from the signal controller 5512, the moving wall drive circuit M11 drives the moving wall drive motor M1 in accordance with the drive permission signal S1. In this embodiment, the moving wall drive circuit M11 drives the moving wall drive motor M1 at a predetermined constant speed when receiving the drive permission signal S1 transmitted from the signal controller 5512.

A drive force generated by the moving wall drive motor M1 is transmitted to the shaft 33 via the third transmission gear 213, the shaft drive gear 382 and the ratchet mechanism RC. In this way, the shaft 33 rotates in the first rotating direction R1. The moving wall 32 moves in the first direction DA along the shaft 33 by the rotation of the shaft 33 in the first rotating direction R1 and conveys the toner in the first space 37S1 of the container body 37 toward the toner discharge port 377. In this way, the moving wall 32 is moved in the first direction DA based on the drive permission signal S1 transmitted from the signal controller 5512 according to the first determination information J1 of the determiner 5511. Thus, a movement of the moving wall 32 is a suitable movement corresponding to the decreasing state of the toner in the first space 37S1.

When the toner is conveyed toward the toner discharge port 377 while the moving wall 32 moves in the first direction DA, a volume of the first space 3751 of the container body 37 is reduced. Thus, the draft surface of the toner in the first space 3751 is located above the inner surface specific area 37K1 (time period TR from time T3 to time T4 of FIG. 27). In this case, the output number of the H signals output from the container sensor 61 becomes equal to or above the reference threshold value and the determiner 5511 outputs the second determination information J2 (time T4 of FIG. 27).

(Concerning Toner Empty Control)

In an example shown in FIG. 27, the image forming operation of the image forming apparatus 1 is finished once at time T5 and the drive of the rotary body drive motor M2 is stopped. Thereafter, the image forming operation of the image forming apparatus 1 is resumed at time T6 and the drive of the rotary body drive motor M2 is started. At times T7 and T8, the signal controller 5512 transmits the drive non-permission signals S2 to the moving wall drive circuit M11 in accordance with the second determination information J2 output from the determiner 5511.

When the toner replenishment control is repeated in accordance with the image forming operation of the image forming apparatus 1 and the toner in the first space 37S1 of the container body 37 continues to be replenished into the developing device 20, the moving wall 32 eventually reaches a final position immediately before the toner discharge port 377.

If the toner falls through the toner discharge port 377 according to a decrease of the toner in the staying portion 29 in the developing device 20 with the moving wall 32 arranged at the final position, the draft surface of the toner is located below the inner surface specific area 37K1 (time period from time T8 to time T9 of FIG. 27). In this case, the output number of the H signals output from the container sensor 61 becomes below the reference threshold value and the determiner 5511 outputs the first determination information J1 (time T9 of FIG. 27).

If the first determination information J1 is output from the determiner 5511, the signal controller 5512 transmits the drive permission signal 51 to the moving wall drive circuit M11 (time T9 of FIG. 27).

With the moving wall 32 arranged at the final position, the internally threaded portion 34J of the pressing member 34 is located at the moving wall stopping portion 34 and disengaged from the externally threaded portion 333. Thus, a moving force is no longer transmitted from the shaft 33 to the pressing member 34. Accordingly, with the moving wall 32 arranged at the final position, the moving wall 32 is stopped at the final position without moving even if the moving wall drive circuit M11 drives the moving wall drive motor M1 in accordance with the drive permission signal 51 (time period from time T9 to time T10 of FIG. 27).

The signal controller 5512 judges whether or not the first determination information J1 has been successively output from the determiner 5511 a predetermined number of times after the transmission of the drive permission signal 51 to the moving wall drive circuit M11.

If the first determination information J1 has been output from the determiner 5511 the predetermined number of times (times T10, T11, T12 of FIG. 27), the signal controller 5512 judges that the toner is empty in the first space 37S1. Then, the signal controller 5512 transmits a drive stop signal S3 to the moving wall drive motor M11, preferentially over the transmission of the drive permission signal 51 (time T13 of FIG. 27). The drive stop signal S3 is a control signal for stopping the drive of the moving wall drive motor M1.

The moving wall drive circuit M11 stops the drive of the moving wall drive motor M1 when receiving the drive stop signal S3 transmitted from the signal controller 5512. Note that even if the first determination information J1 is output after the transmission of the drive stop signal S3 to the moving wall drive motor M11, the signal controller 5512 does not transmit the drive permission signal S1 until the attachment detector 553 detects the attachment of a new toner container 30 to the developing device 20.

As described above, the signal controller 5512 controls to stop the drive of the moving wall drive motor M1 when the toner is empty in the first space 37S1 of the container body 37. In this way, unnecessary drive of the moving wall drive motor M1 is restricted and power consumption can be reduced.

Further, the signal controller 5512 transmits message information indicating that the toner is empty in the first space 37S1 (toner empty information) to the display unit 12 via the communicator 53. In this way, the toner empty information is displayed on the display unit 12. The user can confirm that the toner container 30 is in a toner empty state by seeing the toner empty information displayed on the display unit 12.

Although the embodiment of the present disclosure has been described above, the present disclosure is not limited to this and various modifications can be employed.

(1) Although a monochrome printer is described as the image forming apparatus 1 in the above embodiment, the present disclosure is not limited to this. Particularly, if the image forming apparatus 1 is a tandem color printer, respective toner containers 30 may be mounted from above into the housing 101 to be adjacent to each other in correspondence with a plurality of colors of toners after the upper cover 102B and the front cover 104 of the housing 101 are opened.

(2) Further, although the moving wall 32 moves from the side of the lid portion 31 to the side of the right wall 375 in the above embodiment, the present disclosure is not limited to this. The toner discharge port 377 may be open on the side of the lid portion 31 and the moving wall 32 may move from the side of the right wall 375 to the side of the lid portion 31. Further, the opening position of the toner discharge port 377 is not limited to the above position. The toner discharge port 377 may be open in a lowermost surface part of the container body 37 or may be open at another position.

(3) Further, the developing device 20 is not limited to that of the one-component development method and a two-component development method may be employed.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

a housing including an opening communicating with an internal space where a developing device is disposed;

a cover member attached to the housing and capable of changing a posture between an opening posture for opening the opening and a closing posture for closing the opening;

a developer storage container to be detachably attached to the developing device, the developer storage container including:

a container body having a storage space extending in a first direction and capable of storing a developer and formed with a developer discharge port through which the developer is discharged to the developing device; and a moving wall configured to convey the developer in the storage space toward the developer discharge port by moving in the first direction in the storage space;

a sensor unit including a detection sensor configured to detect the developer stored in the storage space of the container body and output a signal corresponding to the detection;

a moving wall drive controller configured to control a movement of the moving wall based on an output signal output from the detection sensor;

wherein the sensor unit is:

mounted on the cover member and displaced between a detection position where the developer is detectable by the detection sensor and a detection disable position where the developer is not detectable by the detection sensor as the posture of the cover member is changed;

arranged at the detection position where the detection sensor faces a specific area located above the developer discharge port on an outer peripheral surface of the container body when the cover member is in the closing posture; and arranged at the detection disable position where the detection sensor is distant from the specific area when the cover member is in the opening posture.

2. An image forming apparatus according to claim 1, wherein:

the developer storage container further includes:

a rotary body provided near the developer discharge port in the storage space and configured to rotate about a shaft portion extending in the first direction; and a detected member mounted on the rotary body and made of a material enabling detection by the detection sensor; and the image forming apparatus further comprises an attachment detector configured to detect the attachment of the developer storage container to the developing device based on output signals output from the detection sensor in a time period during which the detected member passes through the specific area during the rotation of the rotary body.

3. An image forming apparatus according to claim 2, further comprising:

a cleaning member mounted on the rotary body and configured to scrape off developer adhering to an inner peripheral surface of the container body; wherein:

the cleaning member is mounted at a position on the inner peripheral surface of the container body to pass through an inner surface specific area corresponding to the specific area.

4. An image forming apparatus according to claim 1, wherein:

the sensor unit includes:

a circuit board on which the detection sensor is mounted;

a holder configured to hold the circuit board, including a sensor covering portion configured to cover the detection sensor and supported on the cover member to expose the sensor covering portion; and a biasing member connected between the cover member and the holder and configured to bias the holder in a direction away from the cover member; and the sensor covering portion comes into contact with the specific area of the container body by being elastically pressed by a biasing force of the biasing member to the holder when the sensor unit is arranged at the detection position by setting the cover member in the closing posture.

* * * * *